US009010744B2

(12) United States Patent
Tokuma et al.

(10) Patent No.: US 9,010,744 B2
(45) Date of Patent: Apr. 21, 2015

(54) SHEET PROCESSING APPARATUS AND IMAGE FORMING APPARATUS

(71) Applicant: Canon Kabushiki Kaisha, Tokyo (JP)

(72) Inventors: Naoto Tokuma, Kashiwa (JP); Rikiya Takemasa, Kashiwa (JP); Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 13/937,649

(22) Filed: Jul. 9, 2013

(65) Prior Publication Data

US 2014/0015188 A1 Jan. 16, 2014

(30) Foreign Application Priority Data

| | | |
|---|---|---|
| Jul. 11, 2012 | (JP) | 2012-155355 |
| Sep. 14, 2012 | (JP) | 2012-202798 |
| Sep. 14, 2012 | (JP) | 2012-202799 |
| Jun. 26, 2013 | (JP) | 2013-134035 |

(51) Int. Cl.

| | |
|---|---|
| ***B65H 37/04*** | (2006.01) |
| ***B65H 39/00*** | (2006.01) |
| ***B65H 31/34*** | (2006.01) |
| ***B65H 39/10*** | (2006.01) |
| *B26F 1/44* | (2006.01) |

(52) U.S. Cl.

CPC ..... *B65H 39/00* (2013.01); *B65H 31/34* (2013.01); *B65H 39/10* (2013.01); *B65H 37/04* (2013.01); *B65H 2701/1828* (2013.01); *B65H 2301/5114* (2013.01); *B65H 2301/5126* (2013.01); *B65H 2405/11151* (2013.01); *B65H 2601/2525* (2013.01); *B65H 2601/2531* (2013.01); *B65H 2701/122* (2013.01); *B65H 2701/12213* (2013.01); *B65H 2701/1252* (2013.01); *B65H 2701/18264* (2013.01); *B65H 2701/1829* (2013.01); *B65H 2801/27* (2013.01); *B26F 2001/4418* (2013.01)

(58) Field of Classification Search

CPC ..... B65H 37/04
USPC ..... 270/58.07, 58.08, 58.11, 58.12; 399/410; 414/791.2

See application file for complete search history.

(56) References Cited

U.S. PATENT DOCUMENTS

| | | | | |
|---|---|---|---|---|
| 4,905,979 | A * | 3/1990 | Limbach et al. | 271/176 |
| 5,481,348 | A * | 1/1996 | Mihara et al. | 399/405 |
| 5,599,008 | A * | 2/1997 | Yamashita et al. | 270/58.16 |
| 6,260,837 | B1 * | 7/2001 | Nanba et al. | 270/58.08 |
| 6,328,299 | B1 * | 12/2001 | Coombs | 270/58.08 |
| 6,382,614 | B1 * | 5/2002 | Fukatsu et al. | 270/58.11 |
| 6,561,709 | B2 * | 5/2003 | McVeigh et al. | 400/625 |
| 7,090,213 | B2 * | 8/2006 | Suzuki et al. | 270/58.11 |
| 8,246,033 | B2 * | 8/2012 | Sato | 270/58.09 |
| 8,387,966 | B2 * | 3/2013 | Dinnissen | 270/58.11 |

FOREIGN PATENT DOCUMENTS

| | | |
|---|---|---|
| JP | 09-058924 | 3/1997 |

* cited by examiner

*Primary Examiner* — Patrick Mackey
(74) *Attorney, Agent, or Firm* — Fitzpatrick, Cella, Harper & Scinto

(57) ABSTRACT

A sheet processing apparatus includes a projection forming unit configured to form a projection on a sheet. The projection is formed in the vicinity of a binding portion of a sheet bundle. When a succeeding sheet bundle is discharged on the sheet bundle in which the projection has been formed on a top surface thereof, the succeeding sheet bundle is stacked by moving on the already stacked sheet bundle without being caught by the binding portion of the already stacked sheet bundle as an end of the succeeding sheet bundle is guided by the projection.

18 Claims, 26 Drawing Sheets

FIG.7A1
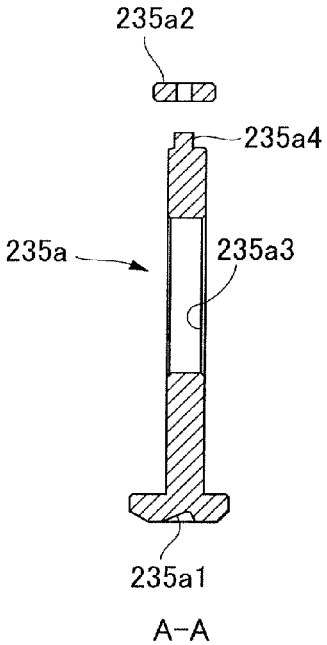
FIG.7A2
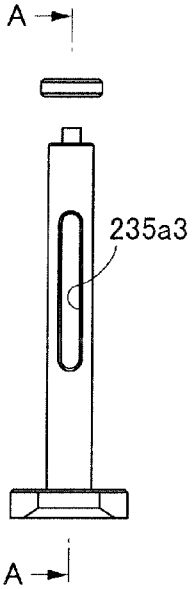
FIG.7A3
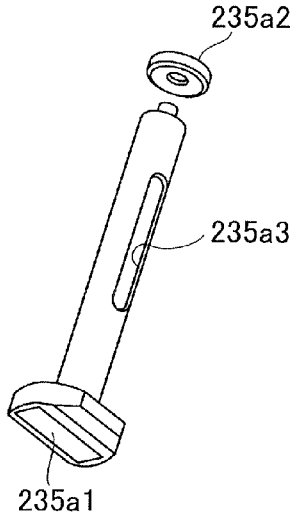
FIG.7B1
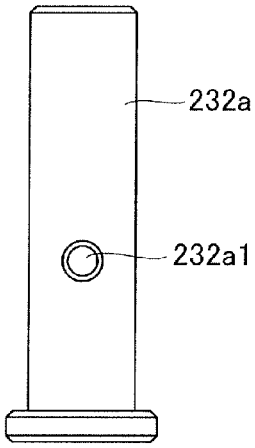
FIG.7B2
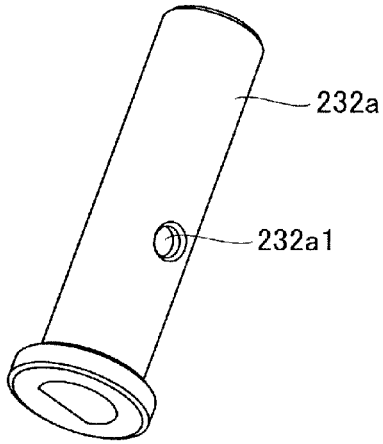

FIG.8A1 FIG.8A2 FIG.8A3
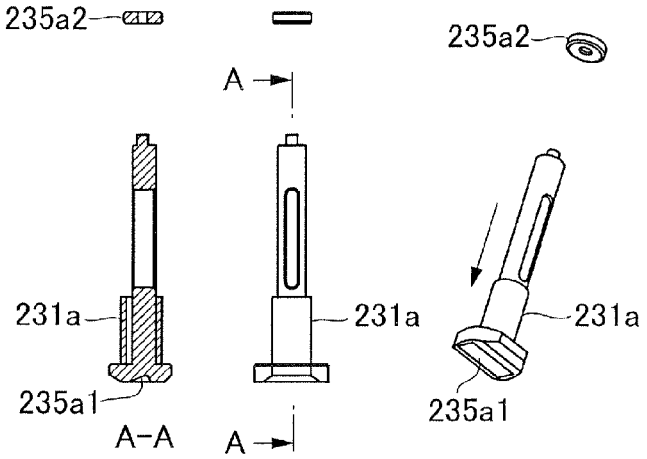
FIG.8B1 FIG.8B2 FIG.8B3
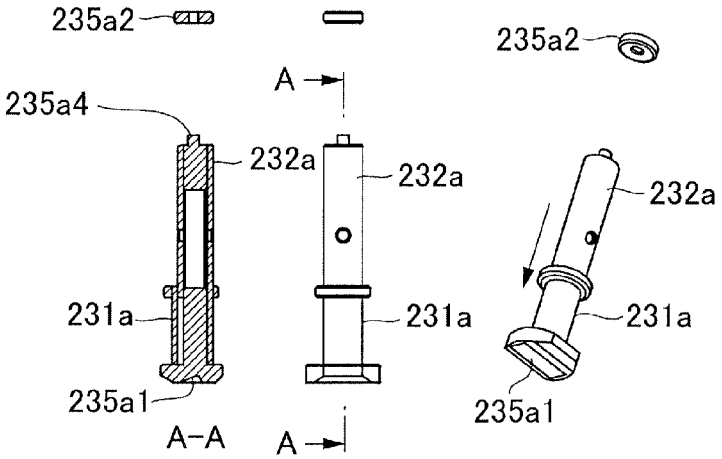
FIG.8C1 FIG.8C2 FIG.8C3
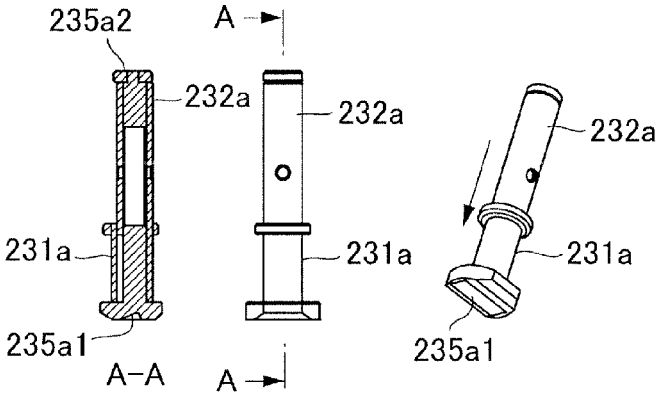

FIG.9A
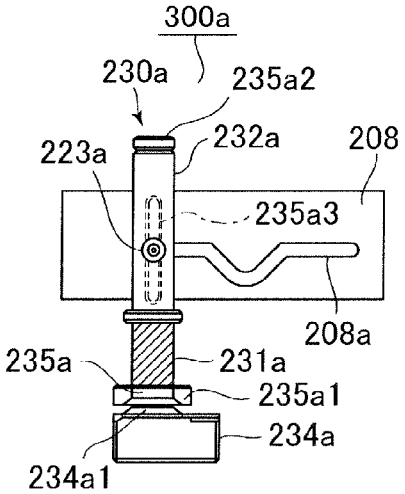
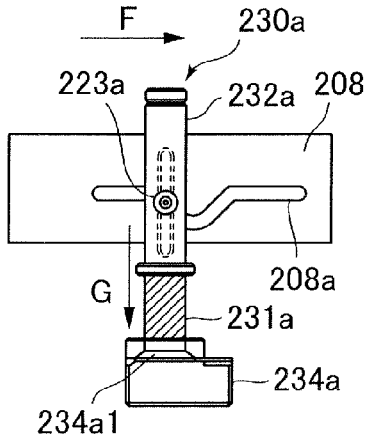
FIG.9B
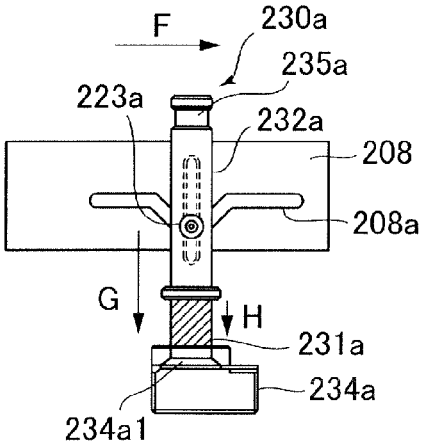
FIG.9C

SHEET PROCESSING APPARATUS AND IMAGE FORMING APPARATUS

BACKGROUND OF THE INVENTION

1. Field of the Invention

The present invention relates to a sheet processing apparatus and an image forming apparatus configured to make a sheet bundle by binding a plurality of sheets.

2. Description of the Related Art

Lately, a configuration of a printing system such as an image forming apparatus, e.g. a copier, a printer, a facsimile, or the like, including a sheet processing apparatus that implements various processes such as binding, punching, sorting, or the like on a sheet on which an image has been formed is widely used. While metallic staples are often used in general in binding sheets in such a sheet processing apparatus, a part of the staple projects above a surface of a sheet bundle when such metallic staple is used.

However, when stapled sheet bundles are stacked one after another on a stacking tray, there is a case when a staple of a sheet bundle to be discharged next is caught by a staple of the sheet bundle already stacked on the stacking tray, thus disturbing alignment of the sheet bundles on the stacking tray. Therefore, there has been proposed such a sheet processing apparatus configured to change stapling position of sheet bundles per every predetermined number of bundles as disclosed in Japanese Patent Application Laid-open No. H9-58924.

However, even though the sheet processing apparatus is to produce products of one and same job, the sheet processing apparatus ends up producing different products because the stapling position of the sheet bundle is differentiated when the sheet processing apparatus changes the stapling position per predetermined number of bundles. Still further, it is necessary to shift a stapling unit largely at least more than a widthwise size of a staple as a shift length of the stapling position to prevent the staples from interfering with each other in view of variations of obliqueness in discharging sheet bundles and a widthwise shift of the sheet bundles in dropping to the stacking tray. If the stapling position of the sheet bundles is shifted largely, the sheets might be turned unevenly, thus damaging the sheets and making the sheet unimpressive.

Still further, although it is possible to solve such a problem that the staples are caught from each other by changing the stapling position, there is a case when a projecting portion of the staple of the already stacked sheet bundle catch an end of a sheet bundle to be discharged next when the stapled sheet bundles are stacked one after another on the stacking tray. In this case, ends of stacked sheet bundles are not justified and tilt on the stacking tray. Thus, the alignment of the sheet bundles is disturbed.

SUMMARY OF THE INVENTION

A sheet processing apparatus of the present invention includes a first stacking portion on which sheets to be processed are sequentially stacked, a binding unit configured to implement a binding process to a sheet bundle composed of a plurality of sheets stacked on the first stacking portion, a sheet bundle moving portion configured to discharge the sheet bundle to which a binding process has been implemented by the binding unit out of the first stacking portion, a second stacking portion configured to stack the sheet bundle discharged out of the first stacking portion by the sheet bundle moving portion, a restricting member configured to abut against an end portion in a moving direction of the sheet bundle discharged and moving on the second stacking portion to align position in the moving direction of the sheet bundle, and a projection forming unit configured to form a guide projection on a top surface of the sheet bundle such that the guide projection guides an end portion in the moving direction of a succeeding sheet bundle moves toward the restricting member above a binding portion of the sheet bundle on the second stacking portion.

Still further, a sheet processing apparatus of the invention includes a first stacking portion on which sheets to be processed are sequentially stacked, a stapler that staples a sheet bundle composed of a plurality of sheets stacked on the first stacking portion, a second stacking portion, having an inclined stacking surface, to which the sheet bundle stapled by the stapler is discharged, an aligning wall against which an end in a moving direction of a sheet bundle moving along an inclination of the stacking surface abuts, a projection forming unit including a punch and a die capable of forming a projection projecting to one side from a surface of a sheet, and a control portion that drives the projection forming unit to form the projection by the punch and die at least on a sheet located at a top surface of the sheet bundle in discharging the sheet bundle to the second stacking portion at position where at least a part of the projection is located on an upstream side in the moving direction of a position stapled by the stapler.

Further features of the present invention will become apparent from the following description of exemplary embodiments with reference to the attached drawings.

BRIEF DESCRIPTION OF THE DRAWINGS

FIGs. 7A1 through 7A3 illustrate a configuration of a punch body, wherein FIG. 7A1 is a section view thereof.

FIG. 7A2 is a side view of the punch body.

FIG. 7A3 is a perspective view of the punch body.

FIGS. 7B1 and 7B2 illustrate a configuration of a slide case, wherein FIG. 7B1 is a side view thereof.

FIG. 7B2 is a perspective view of the slide case.

FIGs. 8A1 through 8A3 illustrate a condition of the punch body before when the slide case is fitted around, wherein FIG. 8A1 is a section view of the punch body.

FIG. 8A2 is a side view of the punch body.

FIG. 8A3 is a perspective view of the punch body.

FIGs. 8B1 through 8B3 illustrate a condition in which the slide case is inserted around the punch body, wherein FIG. 8B1 is a front view the slide case.

FIG. 8B2 is a side view of the side case.

FIG. 8B3 is a perspective view of the slide case.

FIGs. 8C1 through 8C3 illustrate a configuration of a projection forming punch in which a stopper is attached to the punch body, wherein FIG. 8C1 is a section view thereof.

FIG. 8C2 is a side view of the projection forming punch.

FIG. 8C3 is a perspective view of the projection forming punch.

FIG. 9A illustrates a case when a projection forming portion of the projection forming unit is located at an uplift position.

FIG. 9B illustrates a case when the projection forming portion of the projection forming unit is located at a downward position.

FIG. 9C illustrates a case when the projection forming punch of the projection forming unit is located at a bottom dead point.

DESCRIPTION OF THE EMBODIMENTS

A sheet processing apparatus and an image forming apparatus of embodiments of the present invention will be described with reference to the drawings. It is noted that aside of the image forming apparatus where a user faces to a manipulation portion 601 of the image forming apparatus to make various inputs/settings to a copier body 602 will be referred to as a 'front side' of the image forming apparatus, and another side of the image forming apparatus opposite from the front side will be referred to as a 'back side' in the following description. Further, a direction orthogonal to a sheet conveying direction will be referred to as a 'width direction'.

First Embodiment

Figure 1:
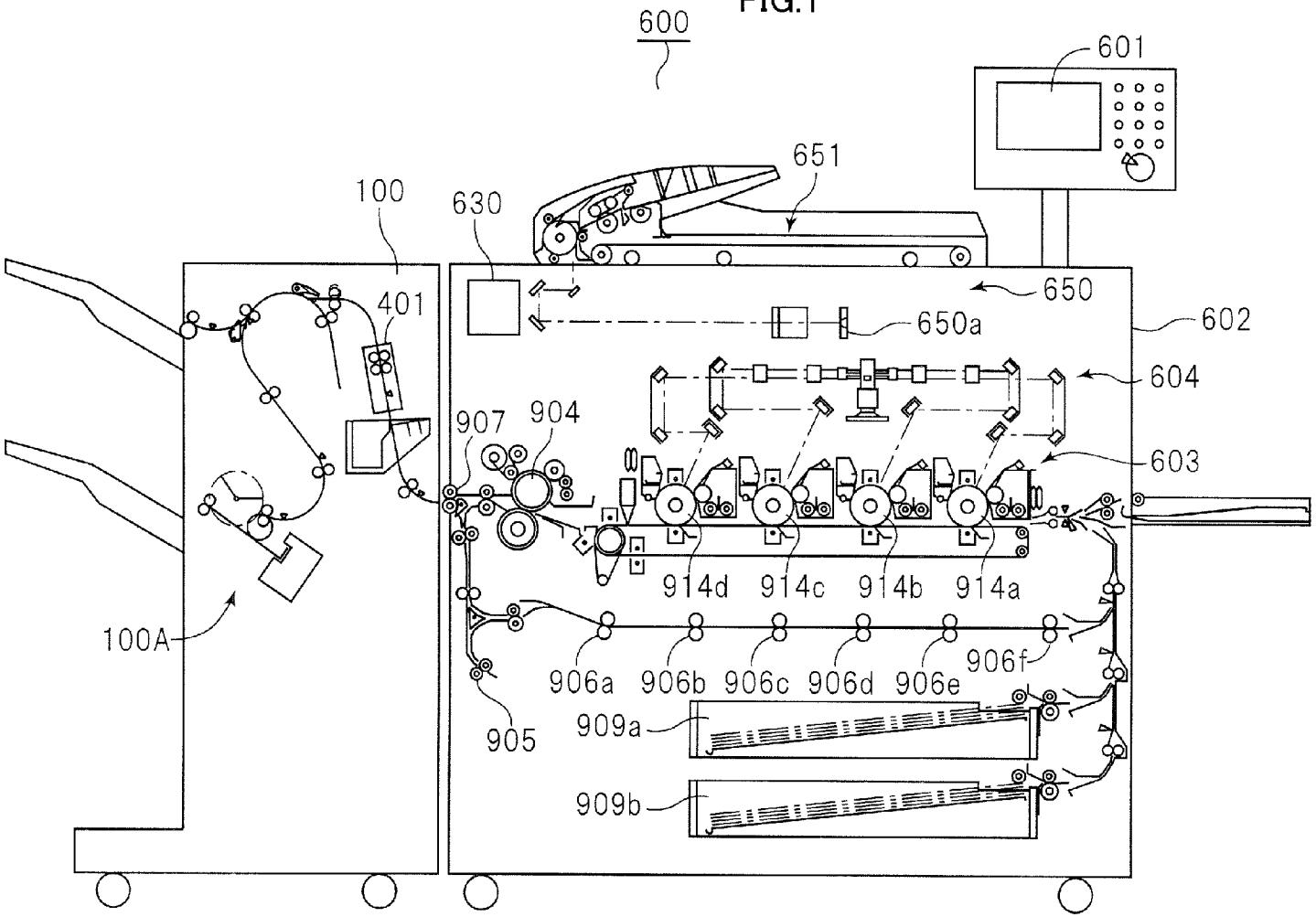
FIG. 1 illustrates a configuration of a color copier as one example of an image forming apparatus including a sheet processing apparatus of a first embodiment.

FIG. 1 illustrates a configuration of a color copier (referred to simply as a "copier" hereinafter) which is one exemplary image forming apparatus including the sheet processing apparatus of the first embodiment of the invention. As shown in FIG. 1, the copier 600 includes a copier body 602, a document reading portion (image reader) 650 provided above the copier body 602, a document feeder 651 configured to automatically read a plurality of documents, and a finisher 100 connected on a side of a copier body 602.

The copier body 602 is provided with sheet feeding cassettes 909*a* and 909*b* configured to stack a normal sheet S on which an image is formed, an image forming portion 603 configured to form a toner image on the sheet by using electro-photographic processes, a fixing portion 904 configured to fix the toner image that has been formed on the sheet, and others. Connected to a top surface of the copier body 602 is a manipulation portion 601 that permits a user to make various inputs and/or settings to the copier body 602, and provided within the copier body 602 is a CPU circuit portion 630, i.e., a control portion, that controls the copier body 602 and the finisher 100.

When an image of a document not shown is to be formed on a sheet in the copier 600, an image sensor 650*a* provided in the document reading portion 650 reads the image of the document conveyed by the document feeder 651 at first. Read digital data is input to an exposure unit 604, which irradiates light corresponding to the digital data to photoconductive drums 914*a* through 914*d* provided in the image forming portion 603.

By being irradiated by the light, each of the photoconductive drums 914*a* through 914*d* forms an electrostatic latent image on a surface thereof. A toner image of each color of yellow, magenta, cyan, and black is formed on the surface of each photoconductive drum by developing the electrostatic latent image.

Then the copier 600 transfers the four colors of toner images on a sheet fed from a sheet feeding cassette 909*a* or 909*b*, and fixes the toner image transferred on the sheet by a fixing portion 904. It is noted that if a mode of the copier 600 is what forms an image on one surface of the sheet, the sheet on which the image has been formed and fixed as described above is discharged out through a discharge roller pair 907 to a finisher 100 connected to a side of the copier body 602.

If the mode of the copier 600 is what forms images on both surfaces of the sheet, the sheet is passed from the fixing portion 904 to a reverse roller 905. After that, the reverse roller 905 is rotated reversely in predetermined timing to convey the sheet toward double-surface conveying rollers 906*a* through 906*f*. Then, the sheet is conveyed again to the image forming portion 603 to transfer toner images of four colors of yellow, magenta, cyan, and black on a back surface of the sheet. It is noted that the sheet in which the four colors of toner images are transferred on the back surface thereof is conveyed again to the fixing portion 904 to fix the toner image. Then, the sheet is discharged through the discharge roller pair 907 and is conveyed to the finisher 100.

<Overall Structure of Finisher>

The finisher 100 is constructed to be able to sequentially take in the sheets discharged out of the copier body 602 and to be able to implement the following sheet processing on the sheet/bundle of sheets (referred to simply as a 'sheet bundle' hereinafter). That is, the processing includes a process of aligning and binding a plurality of taken-in sheets as one sheet bundle, a punching process of perforating holes around a rear end of the taken-in sheets, a binding process of binding an upstream end in a sheet discharge direction of the sheet bundle (referred to as a "rear end" hereinafter), sorting and non-sorting processes, a folding process of folding the sheet bundle, a double-fold bookbinding process, and others.

Figure 2:
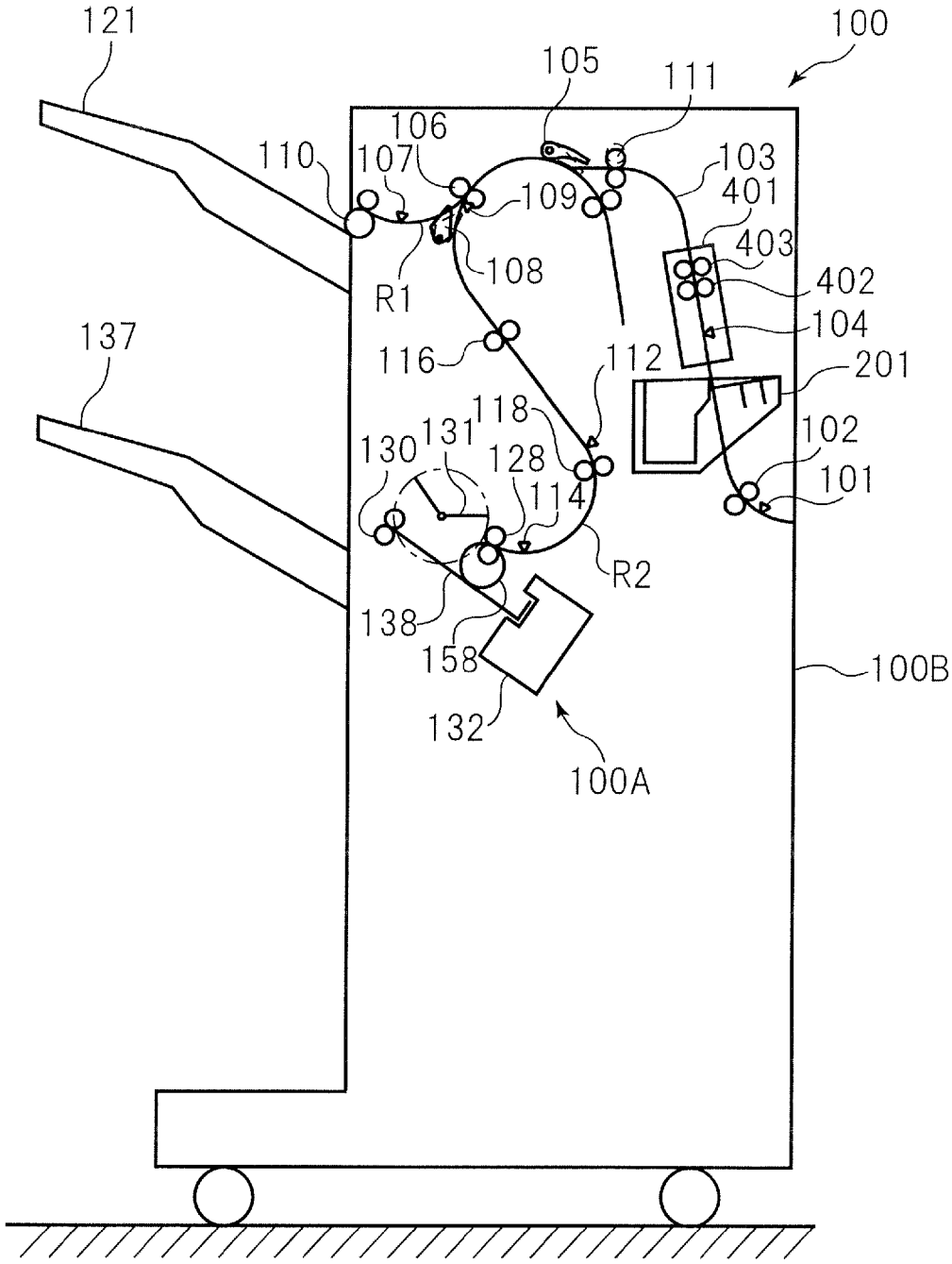
FIG. 2 illustrates a configuration of a finisher, i.e., the sheet processing apparatus described above.

Specifically, the finisher 100 includes a stapler portion 100A which is a unit for binding sheets, a shift unit 401 capable of conveying the sheet in the sheet conveying direction and of shifting the sheet in the width direction, a projection forming unit 201, a folding unit not shown, and others as shown in FIG. 2.

The finisher 100 also includes an inlet roller pair 102 that is disposed at an entrance portion of the finisher 100 to take in the sheet. The inlet roller pair 102 composes a sheet conveying portion together with other conveying roller pairs 111, 106, 116 and 118, and a conveying path 103 and others. The sheet discharged out of the copier body 602 is passed to the inlet roller pair 102, during which an inlet sensor 101 detects the passing timing.

Figure 3:
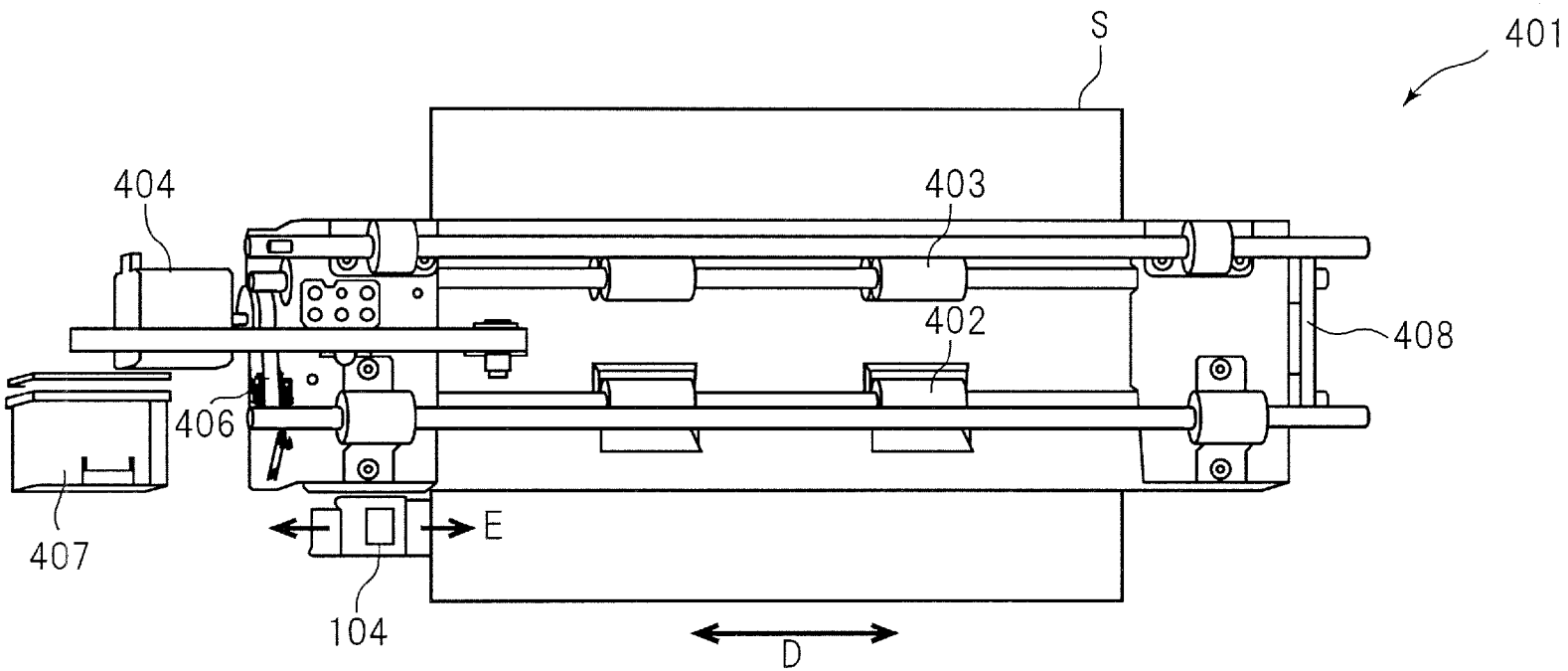
FIG. 3 illustrates a configuration of a shift unit provided in the finisher.

The shift unit 401 is provided downstream in the sheet conveying direction of the projection forming unit 201 along the conveying path 103, and includes shift roller pairs 402 and 403, a transverse registration detecting sensor 104, drive motors 404 and 407, and others as shown in FIG. 3. That is, the shift unit 401 is configured to transmit drive force of the shift conveying motor 404 to the shift roller pair 403 through a drive belt 406, and to link the shift roller pairs 403 and 402 through a drive belt 408. Thus, the shift roller pairs 402 and 403 are rotationally driven. The shift unit 401 is also configured to be able to move the whole shift unit in the width direction (front/back direction) by a shift motor 407.

With this arrangement, when a sheet is conveyed to the shift unit 401, the transverse registration detecting sensor 104 moves in the width direction (in a direction of an arrow E in FIG. 3) and detects a widthwise end position of the sheet to detect how much the sheet deviates widthwise from a center position of the conveying path 103. The shift unit 401 is configured to be able to correct the widthwise position of the sheet when the widthwise deviation (referred to as a 'transverse registration error X' hereinafter) is detected by moving the shift unit itself to the front or back direction (in a direction of an arrow D in FIG. 3) by a predetermined length, e.g., a shift length Z obtained by summing the transverse registration error X and a shift length $\alpha$ of the sheet S, while conveying the sheet by the shift roller pairs 402 and 403.

Still further, a conveying roller pair 111, a buffer roller pair 106 and a change-over member 108 are provided downstream in the sheet conveying direction of the shift unit 401 as shown in FIG. 2. Therefore, the sheet whose widthwise deviation is corrected by the shift unit 401 is conveyed by the conveying roller pair 111 and reaches the buffer roller pair 106. Then, when the sheet is to be discharged to an upper tray 121, the change-over member 108 is turned clockwise by a drive portion such as a solenoid not shown to guide the sheet to an upper conveying path R1. Then, the sheet is discharged on the upper tray 121 by an upper discharge roller 110. In a case when the sheet is not discharged to the upper tray 121, the sheet conveyed by the buffer roller pair 106 is guided to a bundle conveying path R2 by the change-over member 108 and is passed sequentially through the bundle conveying path R2 by a conveying roller 116 and a bundle conveying roller pair 118.

When a folding process is to be implemented on the sheet guided through the bundle conveying path R2, the sheet is sent to a folding unit not shown. When a plurality of sheets is to be discharged on a lower discharge tray (referred to simply as a 'discharge tray' hereinafter) 137 as a sheet bundle, the sheets are conveyed sequentially to a processing tray 138, i.e., a first stacking portion, by a lower discharge roller pair 128. The sheets discharged out of the lower discharge roller pair 128 are aligned by a return portion such as draw-in paddles 131 and a belt roller 158 described later in detail while being sequentially stacked on the processing tray 138 as an aligned sheet bundle.

The sheet bundle composed of the plurality of sheets thus aligned on the processing tray undergoes a binding process implemented by a stapler 132 as necessary, and is discharged sequentially to the discharge tray 137, i.e., a second stacking portion, by a discharge roller pair 130.

<Structure around Processing Tray)

Figure 4:
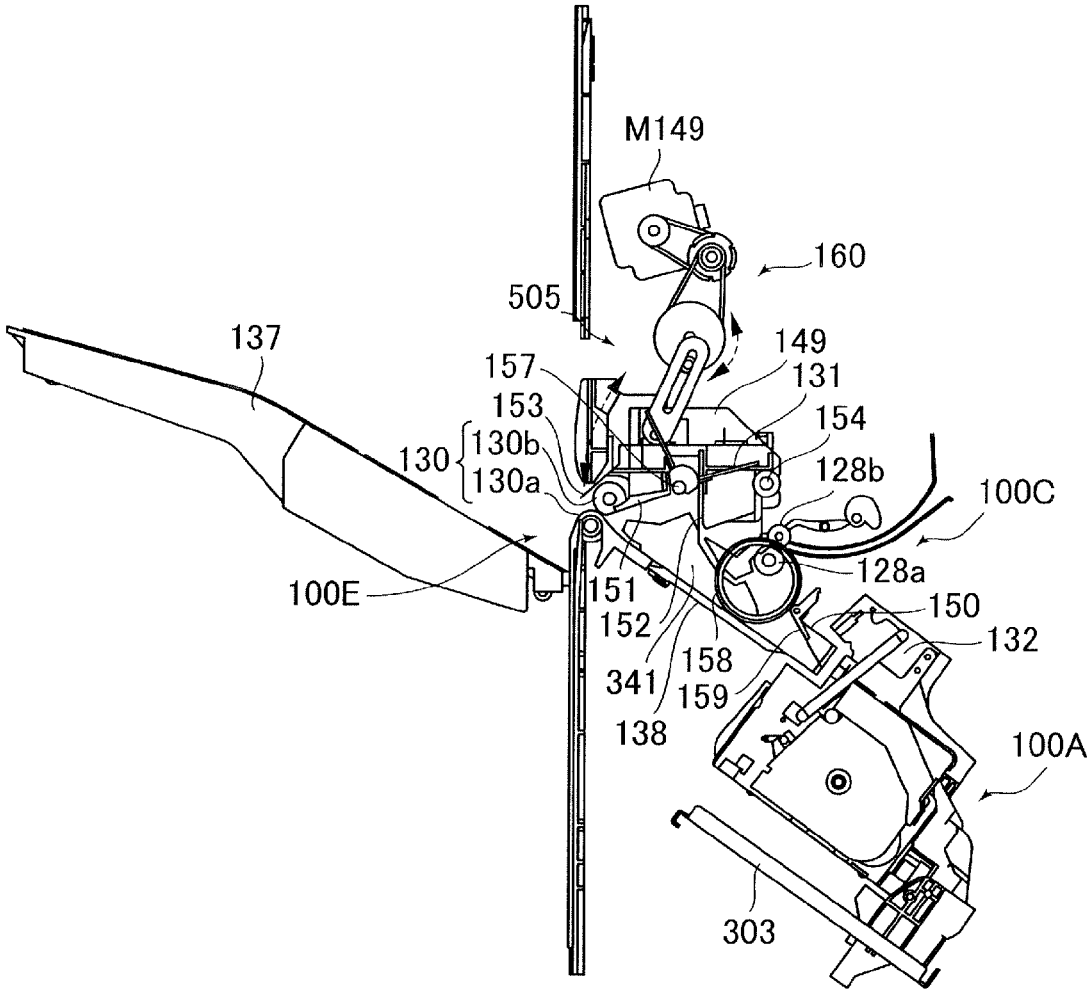
FIG. 4 illustrates a configuration around a processing tray provided in the finisher.

Next, a structure around the processing tray 138 will be described in detail. As shown in FIG. 4, provided around the processing tray 138, besides the processing tray 138, are a sheet rear end aligning portion 100C configured to align position in the sheet conveying direction of the sheets discharged on the processing tray 138, a width aligning portion 100D configured to align (restrict) widthwise position of the sheets discharged on the processing tray 138 (see FIGs. 5A through 5C), a stapler portion (binding unit) 100A configured to implement a binding process on a sheet bundle aligned on the processing tray 138, a sheet bundle moving portion 100E configured to discharge the sheet bundle out of the processing tray 138, and others.

The processing tray 138 is disposed aslant such that a downstream side (left side in FIG. 4) thereof in a bundle discharging direction is positioned up and an upstream side (right side in FIG. 4) thereof is positioned down. A rear end stopper 150 is disposed at a lower end, i.e., the upstream side, of the processing tray 138. The rear end stopper 150 is configured to align position in the conveying direction of the sheets by abutting with rear ends of the sheets. Besides the rear end stopper 150, the sheet rear end aligning portion 100C includes the belt roller 158, the draw-in paddles 131, a rear end lever 159 (159*a* and 159*b*), and others.

The belt roller 158 is wrapped around an outer circumference of the discharge roller 128*a* composing the lower discharge roller pair 128*a* and 128*b*, and is configured such that a lower part thereof comes in contact with an uppermost sheet among the sheets stacked on the processing tray 138 from above at the upstream side in the sheet conveying direction of the processing tray 138.

Figure 5A:
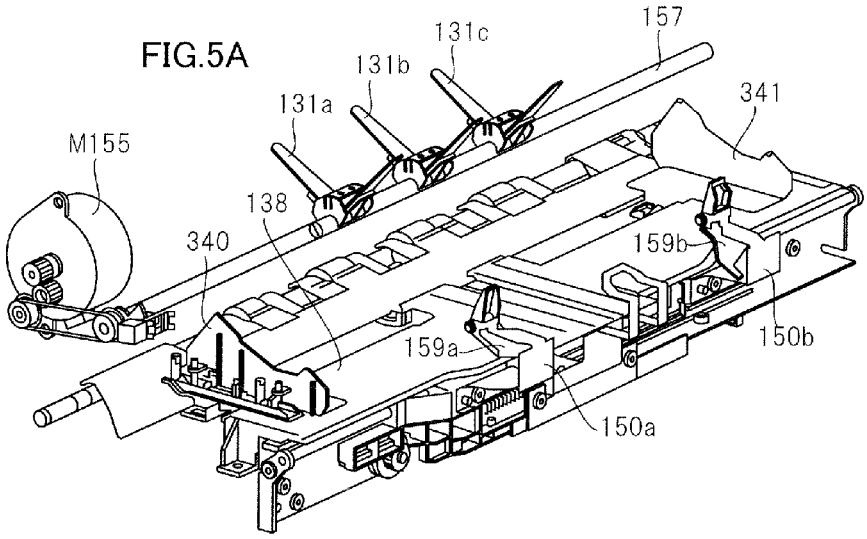
FIG. 5A illustrates a configuration of a sheet rear end aligning portion.

The draw-in paddles 131 are provided above the processing tray 138 and on downstream in the sheet conveying direction of the belt roller 158. The draw-in paddles 131 are rotating members that rotate in a direction, e.g., counterclockwise in FIG. 4, of pressing the sheet S to the rear end stopper 150 side centering on a rotary shaft 157. As shown in FIG. 5A, the plurality of draw-in paddles 131, i.e., 131*a*, 131*b*, and 131*c*, is provided along an axial direction of the rotary shaft 157 that is rotated by a paddle driving motor M155. The plurality of draw-in paddles 131 is arranged to come into contact with a surface of the sheet homogeneously.

Figure 5B:
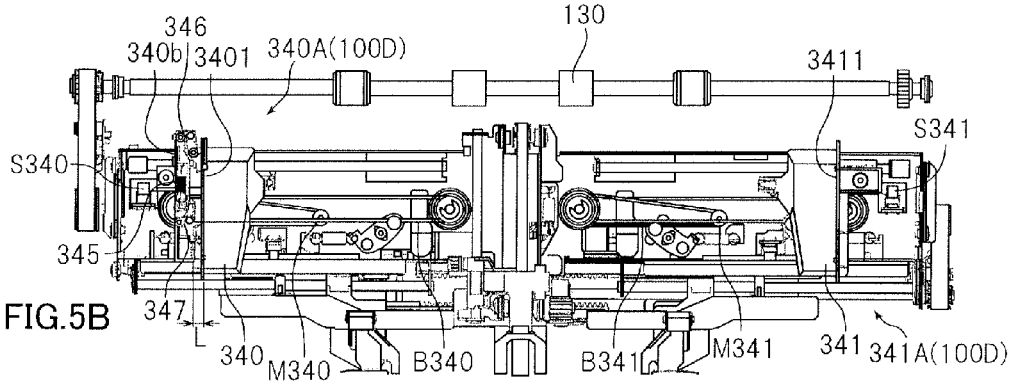
FIG. 5B illustrates a configuration of a widthwise aligning portion.

Meanwhile, as shown in FIG. 5B, the width aligning portion 100D includes front and back aligning portions 340A and 341A provided at an intermediate portion of the processing tray 138. The front and back aligning portions 340A and 341A include, respectively, front and back aligning plates (first and second width aligning members) 340 and 341 and front and back aligning plate motors M340 and M341 that independently drive the front and back aligning plates 340 and 341.

The width aligning portion 100D is configured to transmit driving forces of the front and back aligning plate motors M340 and M341 to the front and back aligning plates 340 and 341 through timing belts B340 and B341 that compose a move portion together with the front and back aligning plate motors M340 and M341 in restricting both side end positions of the sheet S. With this arrangement, the width aligning portion 100D aligns widthwise the sheets stacked on the processing tray 138 by moving and abutting the front and back aligning plates 340 and 341 against the both side ends of the sheets independently along the width direction of the processing tray 138.

That is, the front and back aligning plates (first and second width aligning plates) 340 and 341 are assembled such that their aligning portions (aligning faces) 3401 and 3411 face to each other and are movable reciprocally in a direction of the alignment on the processing tray 138. As a result, even if a sheet or a sheet bundle is conveyed while shifting in the width direction, the front and back aligning plates 340 and 341 make it possible to align the width direction position of the sheets on the processing tray 138.

It is noted that the front aligning plate 340, i.e., the first aligning plate, includes a tension spring 345 between an aligning portion forming the aligning face 3401 vertical to a stacking surface of the processing tray 138 and a body 340*b* of the front aligning plate 340. Therefore, due to the tension spring 345 and moving links 346 and 347, the aligning surface 3401 projects toward a sheet side by a predetermined length L. When the aligning surface 3401 comes into pressure contact with the sheets in restricting the side end position of the sheets, the aligning face 3401, i.e., the pressure contact portion, moves toward the body 340*b* side while resisting against the tension spring 345.

The width aligning portion 100D also includes front and back aligning plate home sensors 5340 and 5341 to detect home positions of the front and back aligning plates 340 and 341, respectively. Due to that, the width aligning portion 100D can make the front and back aligning plates 340 and 341 stand by at the respective home positions set at both ends within a movable range when the width aligning portion 100D is not in operative.

Figure 5C:
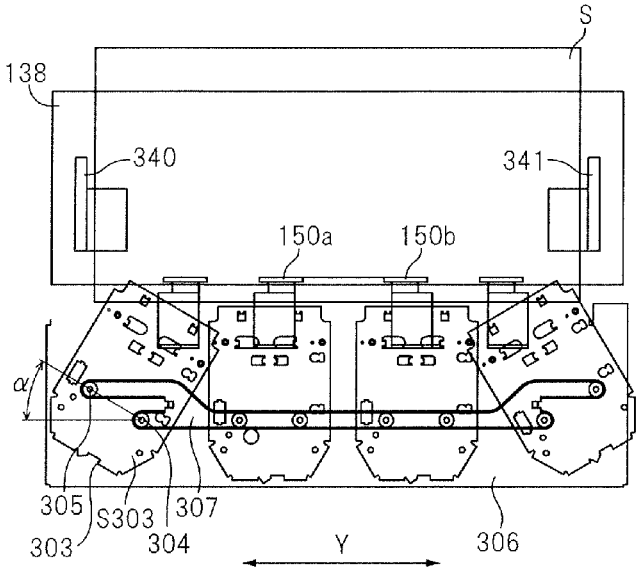
FIG. 5C illustrates a configuration of a stapler portion.

As shown in FIGS. 4 and 5C, the stapler portion 100A includes a stapler 132. The stapler 132 is a portion configured to staple a plurality of sheets stacked on the processing tray 138 as a sheet bundle by a clinch motor not shown, and is fixed on a slide support base 303. Rollers 304 and 305 are provided under the slide support base 303, and a guide rail groove 307 is formed on a top surface of a stapler moving base 306. This arrangement makes it possible to adjust position of the stapler 132 in stapling a sheet bundle by guiding the slide support base 303 by the rollers 304 and 305 and the guide rail groove 307 formed on the stapler moving base 306 such that the slide support base 303 is moved by a stapler moving motor not shown in a direction of an arrow Y in FIG. 5C along a rear edge of the sheets on the processing tray 138.

For instance, when a staple is to be driven into a corner of the sheet S stacked on the processing tray 138, the stapler 132 is kept in a posture inclined by a predetermined angle $\alpha$ (about 30 degrees in the present embodiment) with respect to the rear edge of the sheet. The stapler moving base 306 is provided with a stapler home sensor 5303 that detects a home position of the stapler 132, and the stapler 132 normally stands by at the home position on the front side of the apparatus.

As shown in FIG. 4, the sheet bundle moving portion 100E includes a discharge roller pair 130 and a rocking unit 505. The discharge roller pair 130 includes a lower discharge roller 130*a* rotatably provided at an downstream end in the sheet conveying direction of the processing tray 138 and an upper discharge roller 130*b* provided at a rocking guide 149 of the rocking unit 505. The rocking guide 149 is supported by a support shaft 154 and is configured to be rockable up and down by a rocking motor M149 through an intermediary of a crank portion 160. Therefore, the discharge roller pair 130 is configured such that the upper discharge roller 130*b* provided at an opening end, i.e., a downstream side end in the sheet conveying direction, of the rocking guide 149 is detachable from the lower discharge roller 130*a* in accordance to an opening/closing operation of the rocking guide 149. Accordingly, this arrangement makes it possible to adjust a gap between the rollers of the discharge roller pair 130 in accordance to a thickness of the sheet bundle.

It is noted that the discharge roller pair 130 is configured such that the upper and lower discharge rollers 130*a* and 130*b* can normally and reversely rotate respectively by driving motors not shown. Due to that, the discharge roller pair 130 can not only discharge the sheet bundle discharged by the sheet bundle moving portion 100E to the discharge tray 137, but also abut the sheet S to the rear end stopper 150. The rocking guide 149 is also provided with a guide 151, first and second static charge eliminators 152 and 153 disposed respectively across a whole range of the axial direction.

<Structure of Projection Forming Unit>

Figure 10:
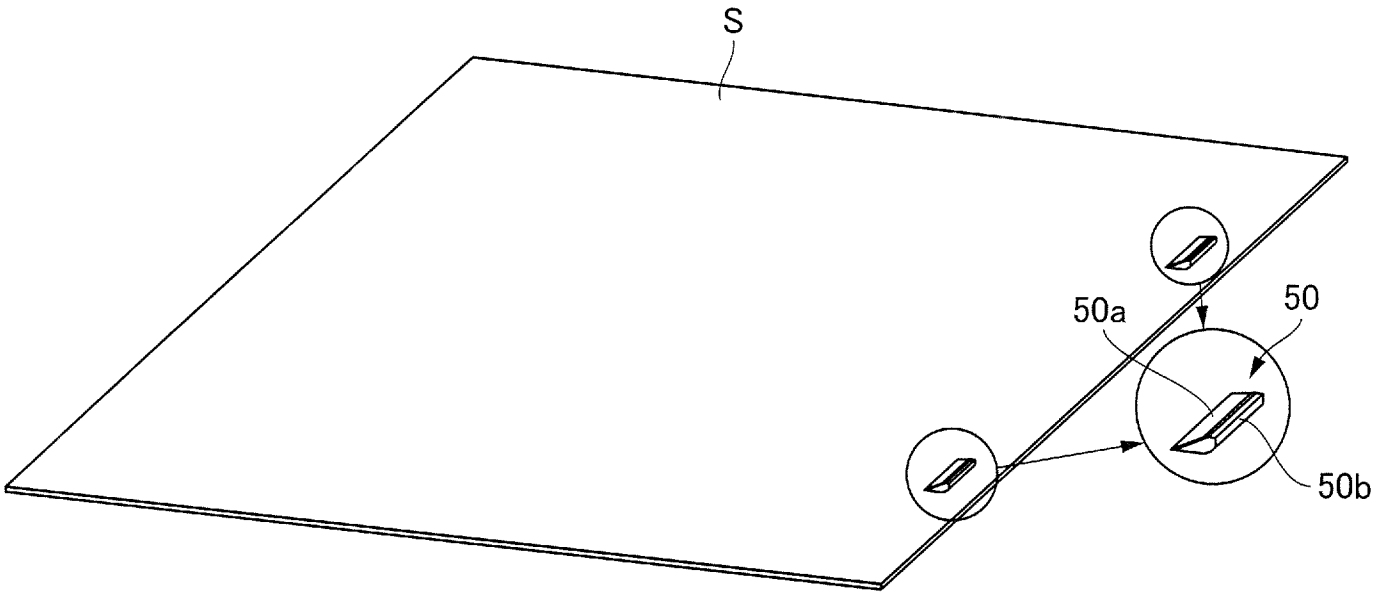
FIG. 10 illustrates projections formed on a sheet by the projection forming unit.

Next, a configuration of the projection forming unit 201 will be described. As shown in FIG. 2, the projection forming unit 201 is disposed upstream in the sheet conveying direction of the shift unit 401 and downstream of the inlet roller pair 102 along the sheet conveying direction, and is constructed to be able to form projections 50 (see FIG. 10) selectively on a sheet such that the projections 50 project to one side from a sheet surface.

Figure 6A:
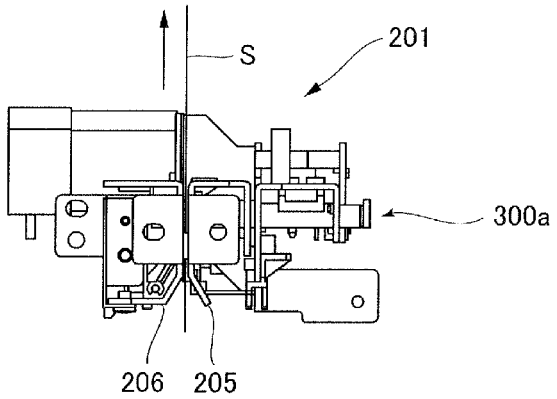
FIG. 6A is a side view showing a projection forming unit provided in the finisher.
Figure 6B:
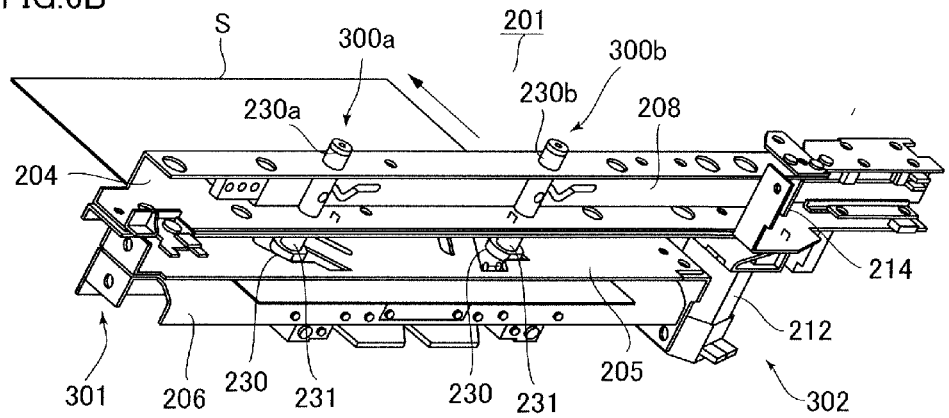
FIG. 6B is a perspective view showing the projection forming unit.
Figure 6C:
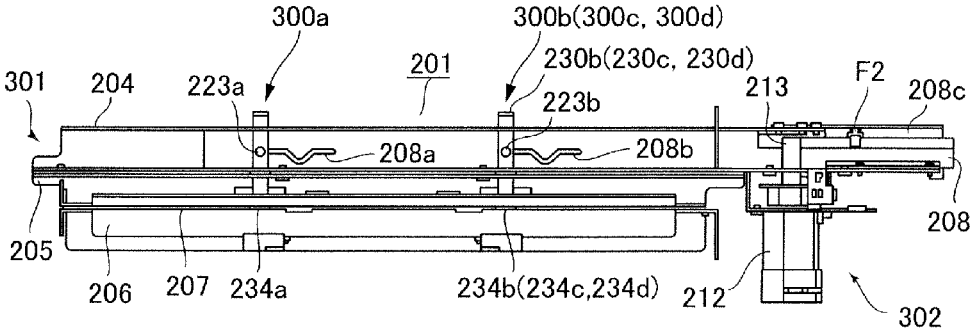
FIG. 6C is a front view showing the projection forming unit.

Specifically, as shown in FIGs. 6A through 6C, the projection forming unit 201 has projection forming portions 300*a* and 300*b* configured to form the projections 50 on the sheet S at two places in the width direction corresponding to the staple positions (binding portion) of the sheet bundle to be stapled by the stapler 132 described above. Besides the right and left projection forming portions 300*a* and 300*b*, the projection forming unit 201 includes a frame 301 configured to support the projection forming portions 300*a* and 300*b* and a drive portion 302 that drives the projection forming portions 300*a* and 300*b*.

The frame 301 includes a punch support guide 204 that supports projection forming punches 230*a* and 230*b* composing the projection forming portions 300*a* and 300*b*, and a die support guide 206 that supports projection forming dies 234*a* and 234*b*. The frame 301 also includes a conveying guide 205 to which the punch support guide 204 and the die support guide 206 are caulked and fixed, and a gap between the punch support guide 204 and the die support guide 206 is made to be a conveying path 207 of the sheet S.

The drive portion 302 includes a slide rack 208 through which right and left cam grooves 208*a* and 208*b* are formed, a gear 213 that engages with the slide rack 208, a moving motor 212 that moves the slide rack 208 in the width direction by rotationally driving the gear 213, and a translucent type slide rack position detecting sensor F2, e.g., a photo-interrupter, that detects position of the slide rack 208.

Parallel pins 223*a* and 223*b* of the projections forming punches 230*a* and 230*b* are fittingly inserted into the cam grooves 208*a* and 208*b* of the slide rack 208, respectively, so that the projections forming punches 230*a* and 230*b* move up and down in accordance to moves of the cam grooves 208*a* and 208*b*.

A structure of the projection forming portions 300*a* and 300*b* will now be described in detail. It is noted that because the right and left projection forming portions 300*a* and 300*b* have the same structure, only the projection forming portion 300*a* will be described in the following explanation and a description of the projection forming portion 300*b* will be omitted here.

The projection forming portion 300*a* includes the projection forming punch 230*a* and a projection forming die 234*a*, and forms the projection 50 by implementing drawing (embossing) to a sheet S by these punch and die. As shown in FIGs. 7A1 through 7B2, the projection forming punch 230*a* includes a cylindrical slide case 232*a* attached vertically slidably to the punch support guide 204 and a punch body 235*a* fittingly inserted into the slide case 232*a*. The punch body 235*a* has a punch portion 235*a*1 having a mold (female mold in the present embodiment) configured to form the projection at one end thereof, and a stopper 235*a*2 fixed to a male screw portion 235*a*4 to prevent the punch body 235*a* from slipping out of the slide case 232*a* at another end thereof. Still further, as shown in FIGs. 8A1 through 8C3, a compression spring 231*a* is provided between the punch portion 235*a*1 of the punch body 235*a* and a lower end of the slide case 232*a* to urge the punch body 235*a* in a direction of separating from the slide case 232*a* (in a downward direction).

That is, as shown in FIGs. 8A1 through 8A3, the projection forming punch 230*a* is assembled by fitting the projection forming pressure spring 231*a* around the punch body 235*a* from above and then fitting the slide case 232*a* around the punch body 235*a* from above in the same manner as shown in FIGs. 8B1 through 8B3. Then, the assemble of the projection forming punch 230*a* is completed by attaching and fastening the stopper 235*a*2 to the male screw portion 235*a*4 of an upper part of the punch body 235*a* from above as shown in FIGs. 8C1 through 8C3. This arrangement makes it possible for the projection forming punch 230*a* to slide up and down within the slide case 232*a*. The projection forming punch 230*a* is urged downward by the projection forming pressure spring 231*a* existing between the punch portion 235*a*1 and the slide case 232*a* and is positioned as a lower surface of the stopper 230*a*4 abuts against a top surface of the slide case 232*a*.

The slide case 232*a* is provided also with a hole 232*a*1 into which the parallel pin 223*a* is driven as shown in FIGS. 7B1 and 7B2, and the parallel pin 223*a* is driven into the hole 232*a*1 after assembling of the projection forming punch 230*a*. One end of the parallel pin 223*a* is inserted into a long hole 235*a*3 provided through the punch body 235*a*. Another end of the parallel pin 223*a* is put into the cam groove 208*a* formed through the slide rack 208.

With this arrangement, when the slide rack 208 moves in the width direction (thrust direction), the parallel pin 223*a* of the projection forming punch 230*a* is pressed by the cam groove 208*a*. Then, the entire projection forming punch 230*a* including the slide case 232*a* is lowered in a direction of an arrow G from an uplift position shown in FIG. 9A to a down position shown in FIG. 9B.

The down position shown in FIG. 9B is a condition in which the projection forming punch 230*a* is in contact with the die portion (male die) 234*a*1 of the projection forming die 234*a* projecting in the conveying path 207. When the slide rack 208 is slid further in a direction of an arrow F in FIG. 9 from this down position, only the slide case 232*a* drops in the direction of the arrow G to a bottom dead point in FIG. 9C along the shape of the cam groove 208*a* and a pressure H in a downward direction is applied to the punch body 235*a* through the intermediary of the compression spring 231*a*. This pressure H is applied to the sheet S located between the projection forming punch 230*a* and the projection forming die 234*a*, so that the projection 50 (see FIG. 10) is formed on the sheet S.

<Control Portion>

Figure 11:
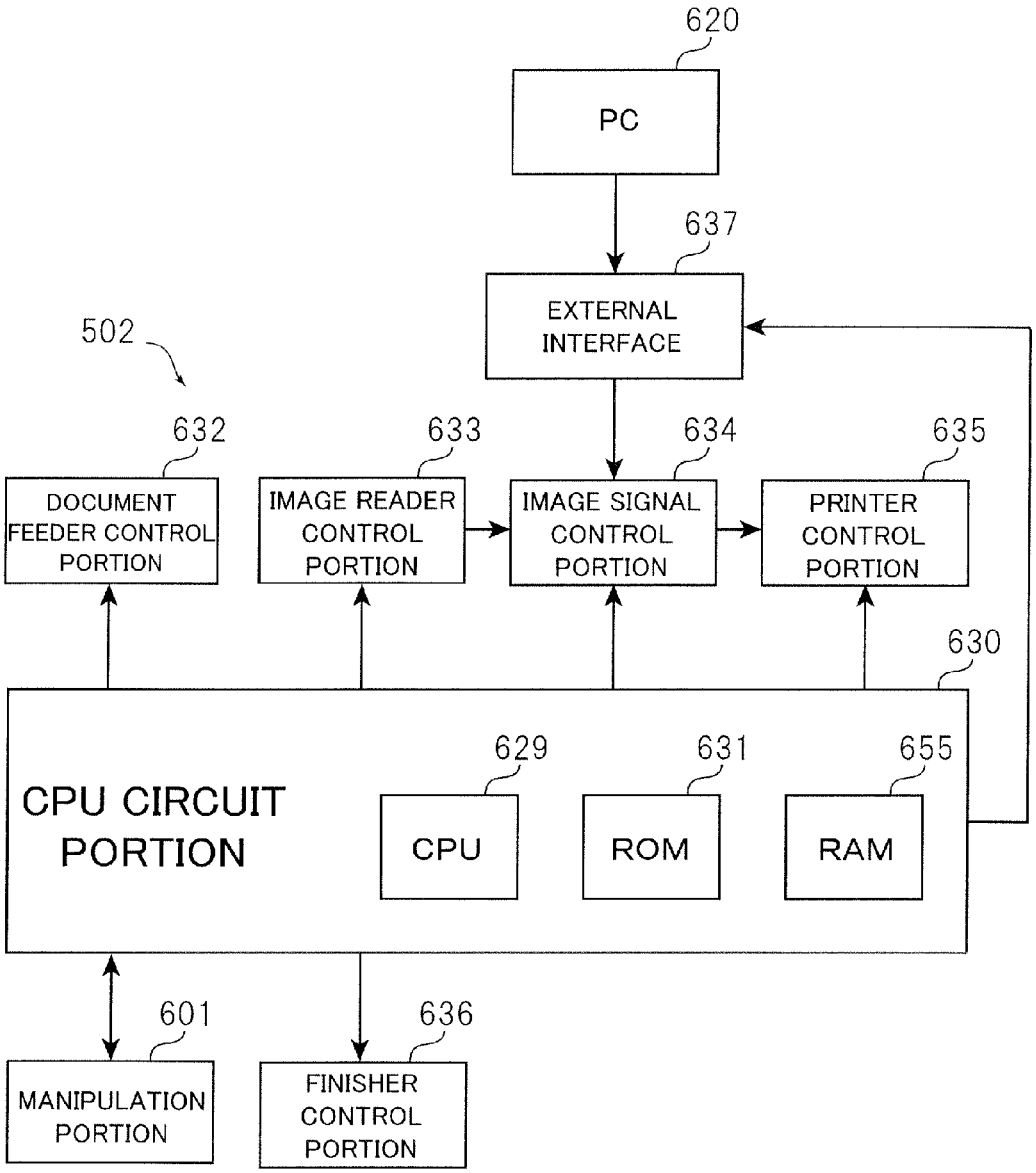
FIG. 11 is a control block diagram of the color copier.

Next, a control portion 502 of the copier (image forming apparatus) 600 will be described. FIG. 11 is a block diagram showing the control portion 502 of the copier 600. As shown in FIG. 11, a CPU circuit portion 630 includes a CPU 629, a ROM 631 and a RAM 655. The CPU circuit portion 630 controls a document feeder control portion 632, an image reader control portion 633, an image signal control portion 634, a printer control portion 635, a finisher control portion 636, and an external interface 637. The CPU circuit portion 630 executes various controls in accordance to programs stored in the ROM 631 and to settings of the manipulation portion 601.

The document feeder control portion 632 controls the document feeder 651 (see FIG. 1) that separates documents stacked on a document stacking tray one by one and feeds to a reading portion of the image reader 650. The image reader control portion 633 controls the image reader 650 (see FIG. 1) that reads the document. The printer control portion 635 controls the copier body 602. The finisher control portion 636 controls the finisher 100. It is noted that the finisher control portion 636 is mounted in the finisher 100 in the present embodiment. However, the present invention is not limited to such configuration, and the finisher control portion 636 may be provided in the copier body 602 integrally with the CPU circuit portion 630 to control the finisher 100 from the side of the copier body 602. It is also possible to arrange such that the finisher 100 is controlled by a control portion of an external computer 620.

The RAM 655 is used as an area for temporarily storing control data and as a working area of calculations involving with the controls. The external interface 637 is an interface connected with the outside computer 620, and develops print data as an image and outputs to the image signal control portion 634. An image read by the image sensor is output from the image reader control portion 633 to the image signal control portion 634, and the image output from the image signal control portion 634 to the printer control portion 635 is input to an exposure control portion.

The finisher control portion 636 is mounted in the finisher 100 and controls driving of the entire finisher by exchanging information with the CPU circuit portion 630 of the body side of the image forming apparatus. The finisher control portion 636 controls various motors and sensors.

Figure 12:
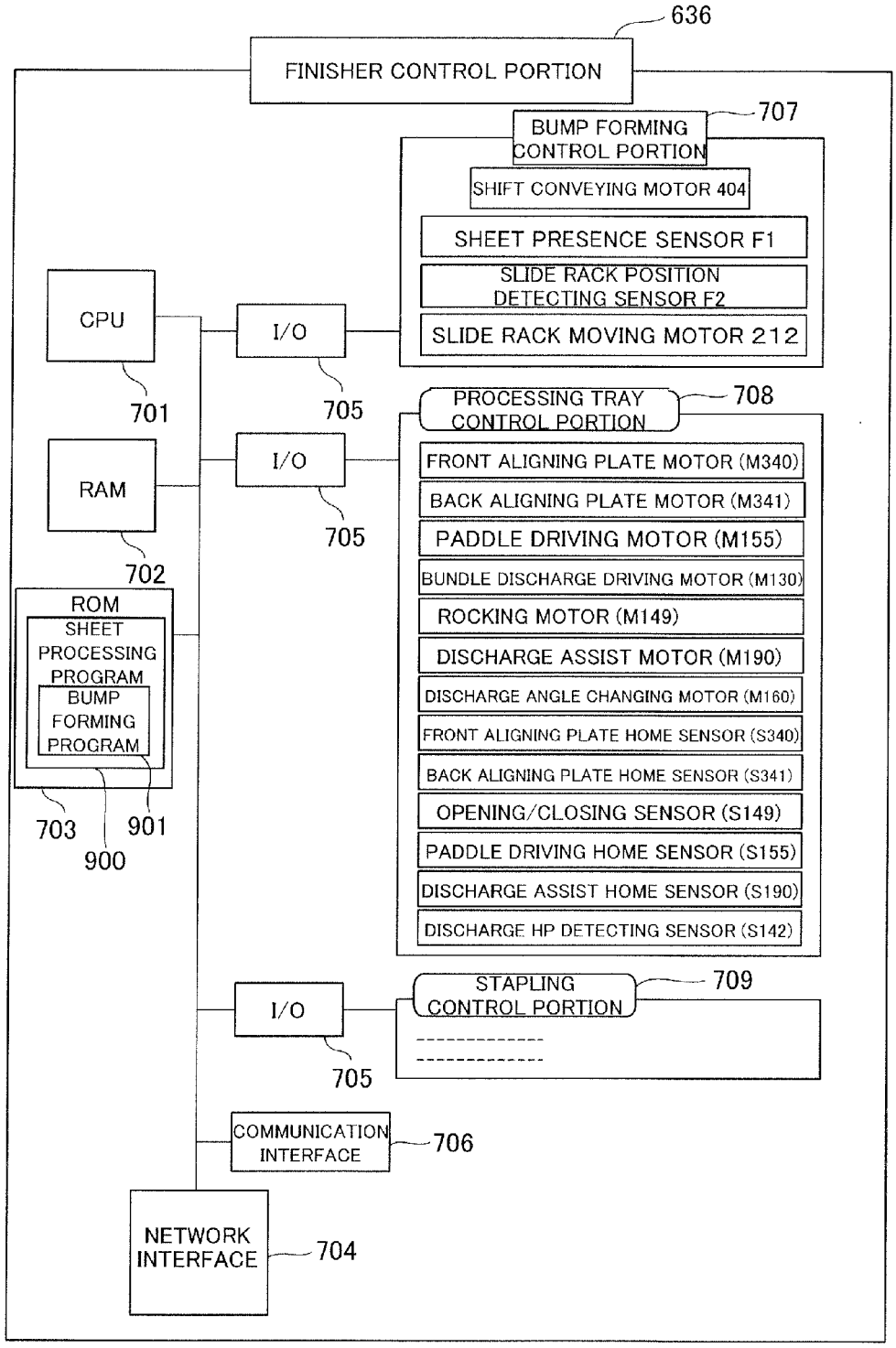
FIG. 12 is a control block diagram of the finisher.

FIG. 12 is a block diagram of the finisher control portion 636 that controls the finisher 100. As shown in FIG. 12, the finisher control portion 636 includes a microcomputer (CPU) 701, a RAM 702, a ROM 703, an input/output portion (I/O) 705, a communication interface 706, and a network interface 704.

As a projection forming control portion 707 and a calculation portion, the microcomputer 701 controls the transverse registration detecting control and the projection forming processes. A processing tray control portion 708, together with the microcomputer 701, controls the moving operation of the width aligning plates, the moving operation of the draw-in paddles, the opening/closing operation of the rocking guide, and the operation for discharging the sheet bundle. A stapling control portion 709, together with the microcomputer 701, controls the stapler moving operation and the clinch operation.

The ROM 703 is connected with the CPU 701 through a bus, and stores a sheet processing program 900 including a projection forming program 901 for implementing the projection forming process described above and various programs for implementing the stapling process and others.

It is noted that the communication interface 706 and the network interface 704 described above are connected to the bus. Due to that, the sheet processing program 900 stored in the ROM 703, i.e., a storage medium, can be read from storage media such as a CD and a flash memory and from the outside by internet communication or the like.

<Sheet Processing Operation>

Next, operations in a staple and sort job of the finisher 100 based on the sheet processing program 900 will be explained with reference to a flowchart shown in FIG. 13.

Figure 13:
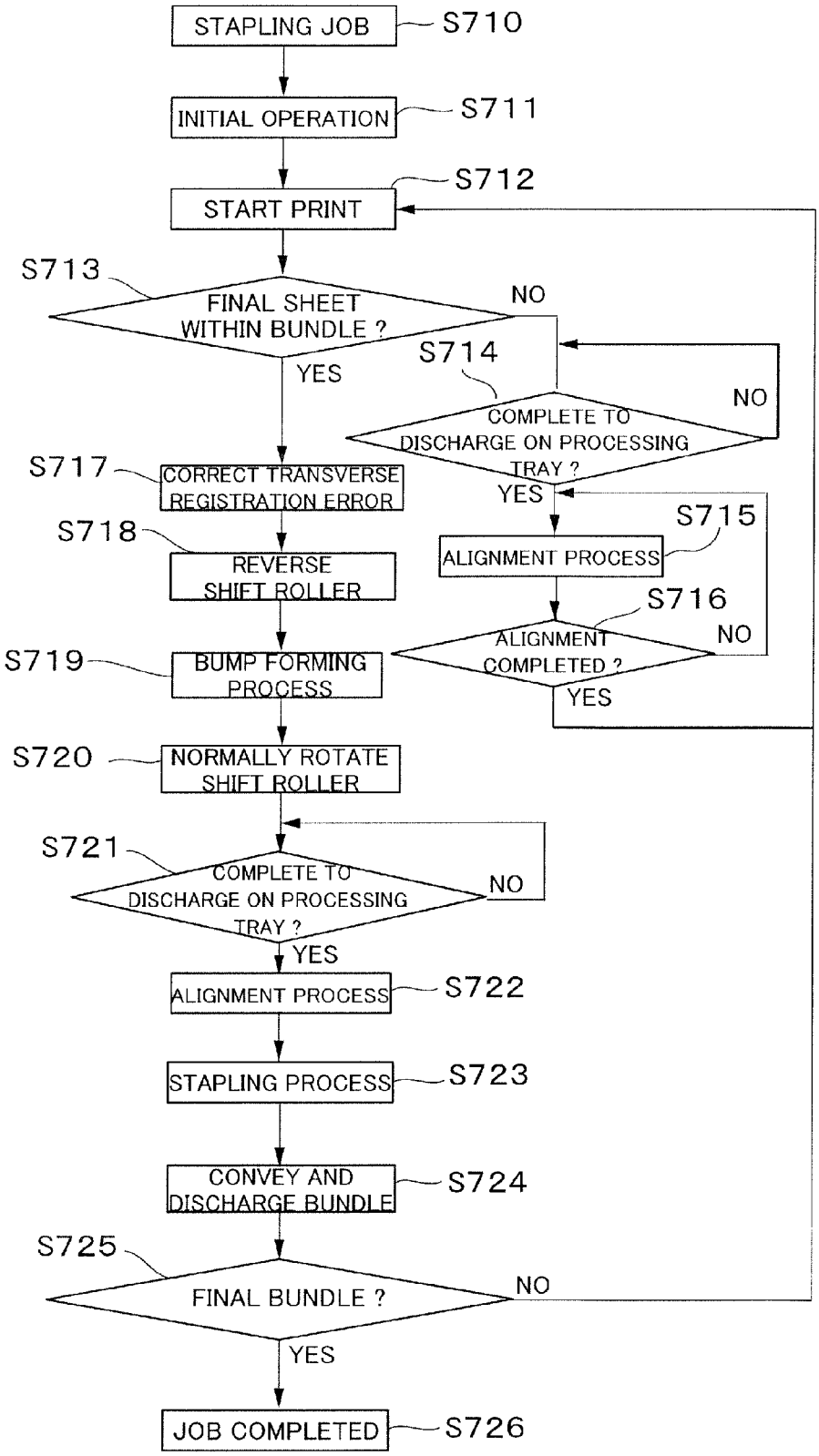
FIG. 13 is a flowchart explaining operations in stapling and sorting jobs of the finisher.

When a print command of a stapling mode is input from the outside computer 620 or the manipulation portion 601 in Step S710 in FIG. 13, the CPU circuit portion 630 on the image forming apparatus body side commands the microcomputer 701 of the finisher control portion 636 to start an initial operation of the projection forming unit 201 in order to put the projection forming punch 230 of the projection forming unit 201 into a stand-by condition (see FIG. 9A) in which the projection forming punch 230 stands by above the projection forming die 234 in Step S711.

Specifically, the finisher control portion 636 receiving the command from the CPU circuit portion 630 confirms a status of the slide rack position detecting sensor F2, and if the slide rack position detecting sensor F2 is OFF (translucent), moves the slide rack 208 in a direction opposite from the direction F in FIG. 9 and stops the slide rack 208 after moving by a predetermined length after the sensor turns ON.

If the slide rack position detecting sensor F2 is ON (light is blocked), the microcomputer 701 once moves the slide rack 208 in the direction F in FIG. 9 to turn OFF the slide rack position detecting sensor F2. Then, the microcomputer 701 moves the slide rack 208 in the opposite direction and stops the slide rack 208 after moving a predetermined length after the sensor turns ON. It is noted that because the slide rack moving motor 212 is provided with an encoder on a motor shaft, the microcomputer 701 controls rotation of the slide rack moving motor 212, i.e., a moving length of the slide rack 208, based on signals from this encoder.

When the initial operation is executed, the CPU circuit portion 630 gives a print command to the printer control portion 635 to start print an image in Step S712. In the same time with the print command given to the printer control portion 635, the CPU circuit portion 630 commands the microcomputer 701 of the finisher control portion 636 to execute a binding process.

By receiving the stapling command from the CPU circuit portion 630, the microcomputer 701 (the finisher control portion 636) actuates the change-over member 108 to change over the conveying path 103 to the bundle conveying path R2 (see FIG. 2). Then, when the sheet S on which an image has been formed is conveyed from the copier body 602 to the conveying path 103 of the finisher 100, the microcomputer 701 judges whether or not the conveyed sheet S is a final sheet S1F of a sheet bundle to be stapled in Step S713. If the sheet S is not the final sheet S1F, i.e., NO in Step S713, the microcomputer 701 passes the sheet S without forming a projection 50 by the projection forming unit 201 and discharges to the processing tray 138 by the lower discharge roller pair 128*a* and 128*b* after correcting a transverse registration error by the shift unit 401, i.e., YES in Step S714.

Figure 14A:
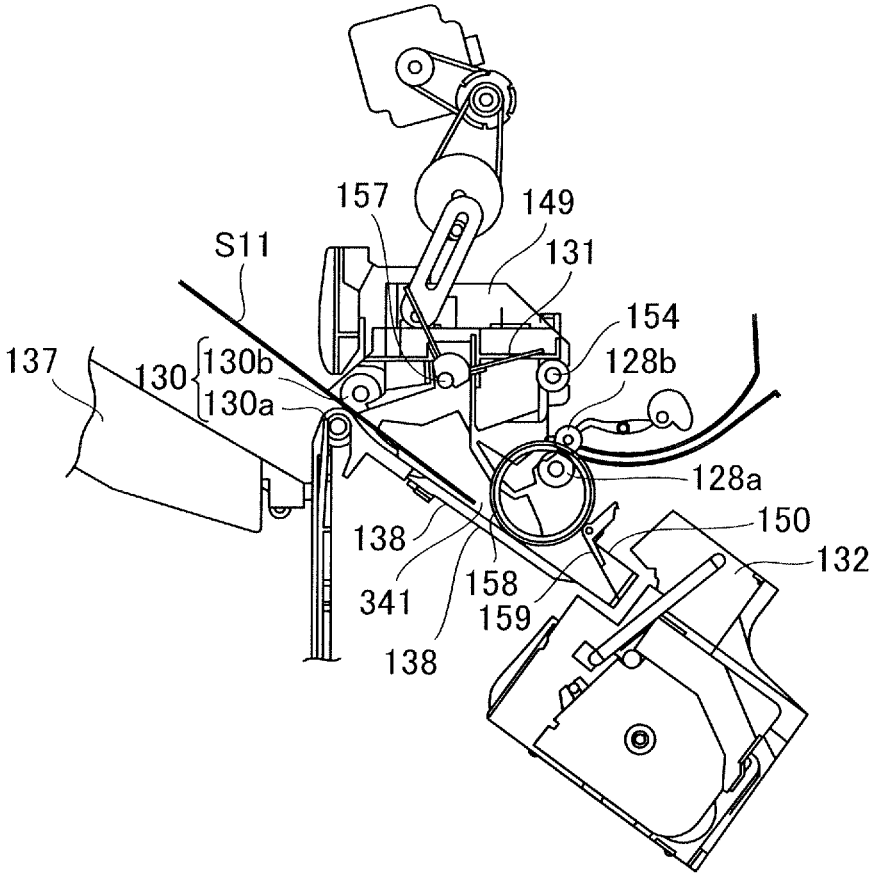
FIG. 14A illustrates a condition in which a sheet is discharged on a processing tray in an operation for aligning a first sheet discharged on the processing tray.
Figure 14B:
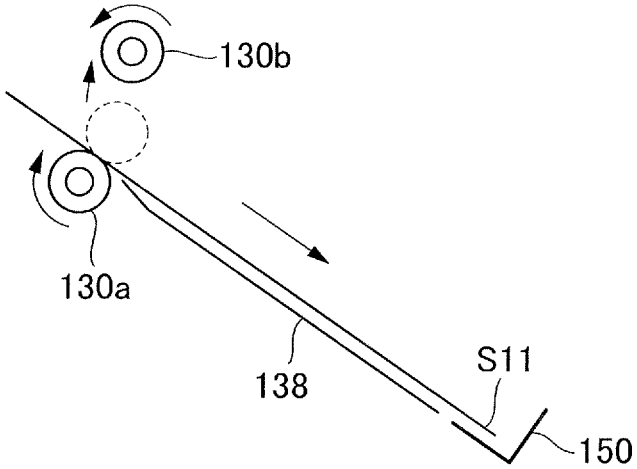
FIG. 14B illustrates a condition in which the sheet is conveyed toward a rear end stopper in the operation for aligning the first sheet discharged on the processing tray.

A first sheet S11 discharged first to the processing tray 138 is conveyed from the lower discharge roller pair 128*a* and 128*b* to the discharge roller pair 130 as shown in FIG. 14A. When the first sheet S11 is pinched by the discharge roller pair 130, the microcomputer 701 reverses the discharge roller pair 130 and conveys the sheet S11 in the direction opposite from the discharge direction toward the rear end stopper 150 as shown in FIG. 14B. The microcomputer 701 also raises the rocking guide 149 before a rear end of the sheet S11 abuts against the rear end stopper 150. Thereby, the upper and lower discharge rollers 130*b* and 130*a* separate from each other and the sheet S11 abuts against the rear end stopper 150 by its inertia, so that an end position of the sheet S11 in the sheet conveying direction is aligned.

Figure 15A:
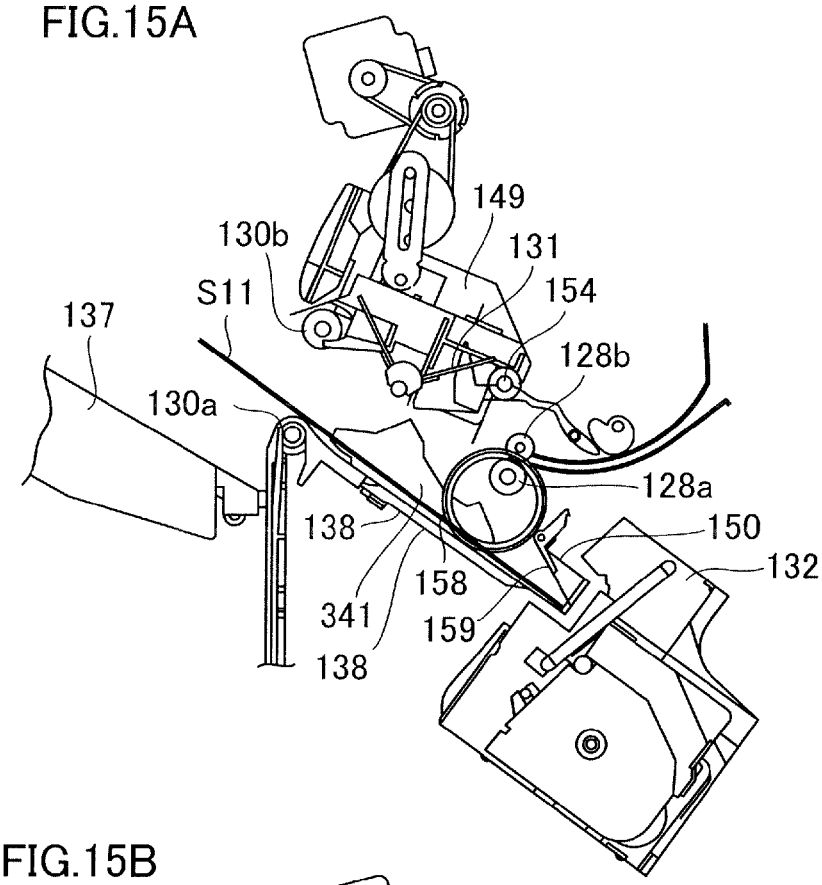
FIG. 15A illustrates a condition in which the first sheet abuts against the rear end stopper in the operation for aligning the sheet discharged on the processing tray.

When the alignment of the upstream end (rear end) in the sheet conveying direction of the sheet S11 ends in Step S715, the microcomputer 701 implements the alignment of the sheet S11 in the width direction orthogonal to the sheet conveying direction by the front and back width aligning plates 340 and 341 as shown in FIG. 15A. The alignment process of the sheet S11 is completed by thus aligning the sheet S11 in the sheet conveying direction and the width direction in Step S716.

Figure 15B:
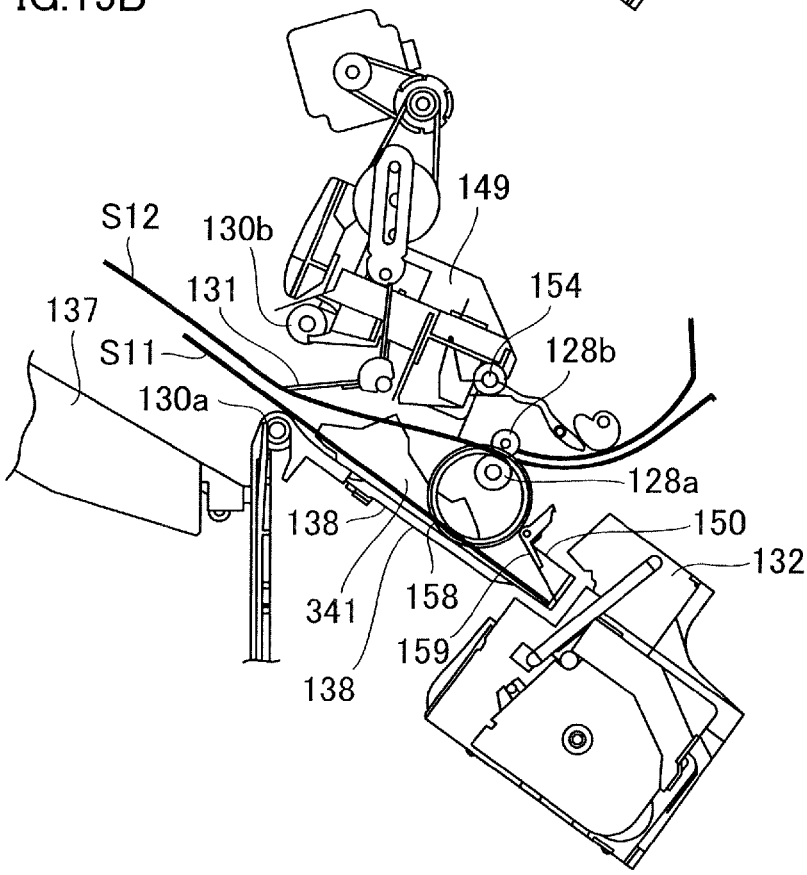
FIG. 15B illustrates a condition in which a second sheet is discharged on the processing tray in the operation for aligning a sheet discharged on the processing tray.

When the alignment of the first sheet S11 ends, a second sheet S12 is discharged to the processing tray 138 as shown in FIG. 15B in Step S714. At this time, the rocking guide 149 is located at the uplift position and the sheet S12 enters in the condition in which the upper and lower discharge rollers 130*b* and 130*a* are separated from each other. The microcomputer 701 conveys the sheet S12 discharged on the processing tray 138 toward the rear end stopper 150 by rotationally driving the draw-in paddles 131 as shown in FIG. 15B.

The second sheet S12 drawn in by the draw-in paddle 131 is conveyed to the rear end stopper 150 further by the belt roller 158 and is aligned as the rear end of the sheet abuts against an abutment face of the rear end stopper 150. When the alignment of the upstream end (rear end) in the sheet conveying direction of the sheet S12 ends, the alignment in the width direction is carried out in the same manner with the first sheet S11 by the pair of aligning plates 340 and 341 in Step S715.

The finisher 100 carries out the abovementioned series of alignment operations to the sheets S conveyed to the finisher 100 and stacks and aligns the plurality of sheets on the processing tray 138 in Steps S712 through S716. When a final sheet S1F within the sheet bundle to be stapled is conveyed to the finisher 100, i.e., YES in Step S713, the microcomputer 701 forms the projection 50 on the sheet S1F by the projection forming unit 201. It is noted that this final sheet S1F is a sheet on an uppermost surface of the sheet bundle on the discharge tray 137, and becomes either a front surface or a back surface of the sheet bundle.

Figure 16A:
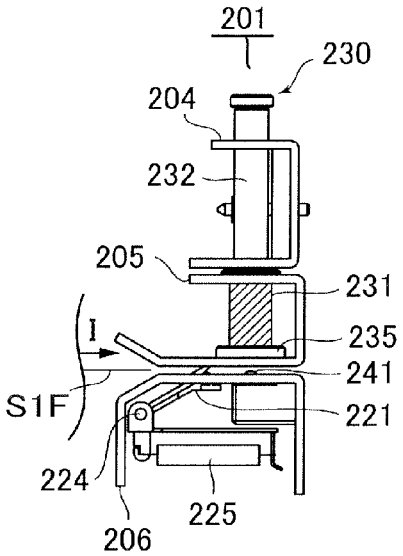
FIG. 16A illustrates a condition in which a sheet is about to enter a shift unit in the operation of the projection forming unit.
Figure 16B:
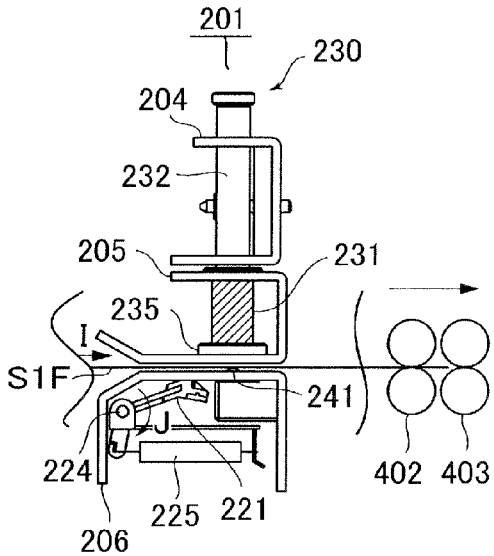
FIG. 16B illustrates a condition in which the sheet has entered the shift unit in the operation of the projection forming unit.

Specifically, when the final sheet S1F enters the projection forming unit 201 from a direction of an arrow I as shown in FIG. 16A, the sheet S1F arrives at the shift unit 401 by pushing a rear end stopper (stopper member) 221 of the projection forming unit 201 in a direction of an arrow J by its leading edge as shown in FIG. 16B.

When the final sheet S1F enters the shift unit 401, the transverse registration detecting sensor 104 detects a transverse registration error X and the shift unit 401 moves the sheet S1F to a predetermined thrust position so that it conforms with a projection forming position in Step S717. The move of the shift unit 401 is carried out while conveying the sheet S. When the rear end of the sheet S1F slips out of the rear end stopper 221, the rear end stopper 221 turns counterclockwise centering on the turning shaft 224 by a connected spring 225 and returns to the original position projecting on the sheet conveying direction.

Figure 16C:
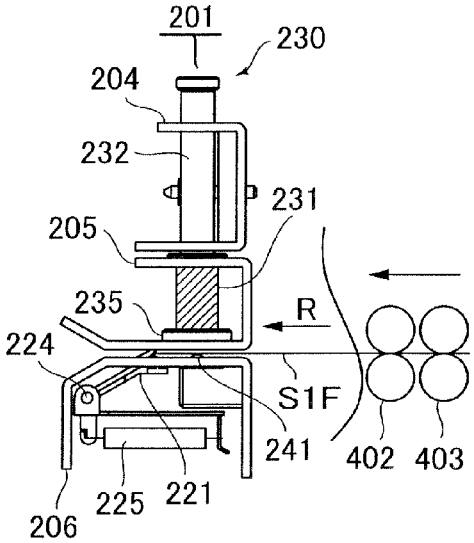
FIG. 16C illustrates a condition in which the sheet is switched back in the operation of the projection forming unit.
Figure 16D:
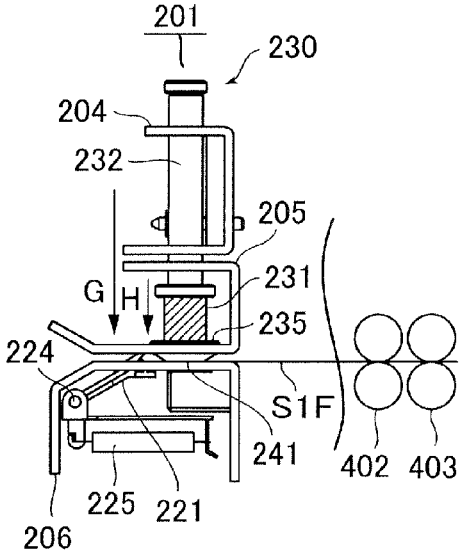
FIG. 16D illustrates a condition in which a projection is formed on the sheet in the operation of the projection forming unit.

When the sheet S1F slips out of the rear end stopper 221, the microcomputer 701 reverses the shift roller pairs 402 and 403 to switch back the sheet S1F and to abut against the rear end stopper 221 in Step S718 as shown in FIG. 16C. Thereby, the projection forming position from the sheet rear end of the sheet S1F is determined. When the projection forming position of the projection 50 of the sheet S1F is determined, the microcomputer 701 lowers the projection forming punch 230 by the driving portion 302 (see FIG. 6) to form the projection 50 on the sheet S1F in Step S719. It is noted that the microcomputer 701 can send the sheet S1F properly to the rear end stopper 221 based on ON timing of a sheet presence sensor F1 disposed in the shift unit 401 as described later and shown in FIG. 12 and a predetermined feed length corresponding to a size of the sheet.

When the projection 50 is formed on the final sheet S1F, the microcomputer 701 rotates the shift roller pairs 402 and 403 normally to convey the sheet S1F on which the projection 50 has been formed to the processing tray 138 in Step S720. When this final sheet S1F is also discharged to the processing tray 138, i.e., YES in Step S721, the alignment process in the sheet conveying direction and width direction is implemented in the same manner as implemented on other sheets in Step S722.

Figure 17A:
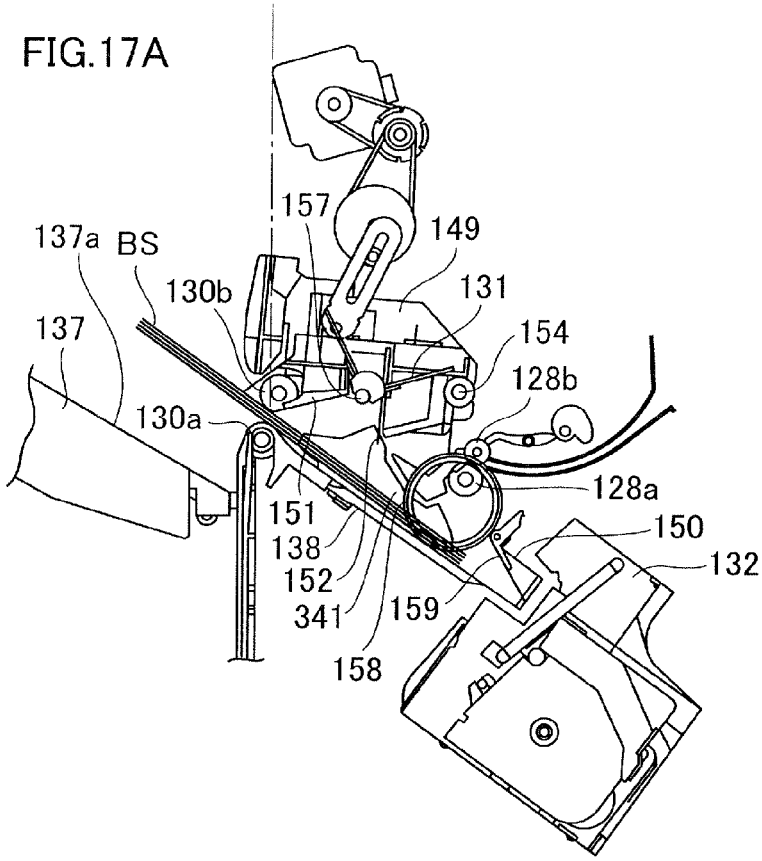
FIG. 17A illustrates a condition in which a sheet bundle is discharged to a discharge tray.

When the alignment operation of the final sheet S1F ends, the microcomputer 701 activates the stapler 132 to staple the rear edge of the sheet bundle in Step S723. Then, the microcomputer 701 drops the rocking guide 149 as shown in FIG. 17A to pinch the sheet bundle by the discharge roller pair 130 to discharge to the discharge tray 137 in Step S724.

Figure 17C:
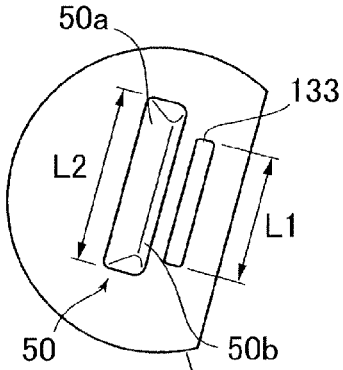
FIG. 17C is an enlarged view of a projection shown in FIG. 17B.
Figure 17B:
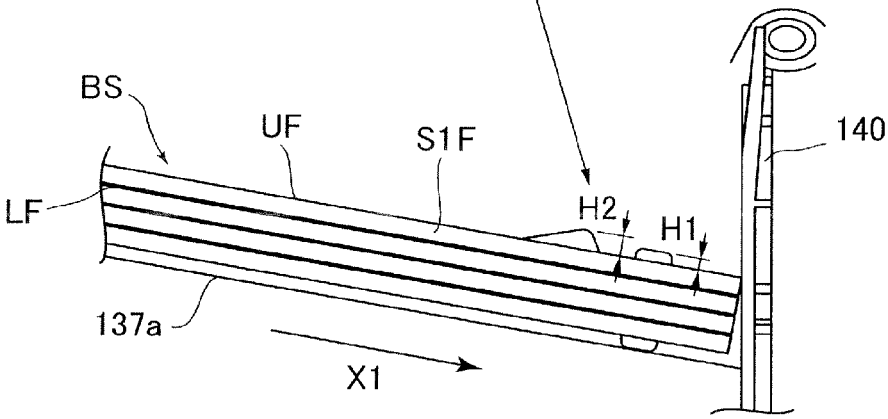
FIG. 17B illustrates the sheet bundle on the discharge tray.

Because the discharge tray 137 has an inclined stacking surface 137*a* declined with respect to an aligning wall 140 as shown in FIG. 17B, the sheet bundle BS discharged to the discharge tray 137 moves along the inclination of the stacking surface 137*a* of the discharge tray 137 and a downstream end portion thereof in the moving direction abuts against the aligning wall 140, i.e., a side wall of the finisher 100. The aligning wall 140 is a restricting member that restricts position in the moving direction (discharge direction) of the sheet bundle BS by abutting against the downstream end portion in the moving direction (upstream end portion in the discharge direction) of the sheet bundle BS discharged to the discharge tray 137. The sheet bundle BS is thus aligned in the discharge direction by abutting against the aligning wall 140.

Here, because the projection 50 has been formed on the final sheet S1F of the sheet bundle BS, the projection 50 is formed only on the top surface sheet of the sheet bundle BS. This projection 50 projects in a direction from a back surface side LF where the final sheet S1F comes in contact with another sheet within the sheet bundle to a surface side UF opposite from the back surface, and is formed in the vicinity of a staple 133, i.e., a binding member for binding the sheet bundle BS.

Specifically, the projection 50 is formed at a guide position (position shown in FIGS. 17B and 17C) in the vicinity of the staple 133 and upstream of the staple position where the sheet bundle is stapled by the stapler in a direction F1 in which the sheet bundle moves toward the aligning wall 140 on the discharge tray (referred to simply as a 'moving direction' or a 'sheet bundle moving direction' hereinafter). That is, at least a part of the projection 50 is formed on a side opposite from the aligning wall 140 in the sheet bundle moving direction with respect to a portion where the sheet bundle is stapled.

The projection 50 is formed into a shape of a mountain whose slope 50*a* on the upstream side viewed from the aligning wall 140 when the sheet bundle BS is discharged to the discharge tray 137 is moderate as compared to a slope 50*b* on a downstream side. That is, the slope 50*a* is formed such that it is gradually heightened toward the aligning wall 140. The projection 50 is also formed such that a height H2 thereof is higher than a height H1 of the staple 133 projecting above the top surface sheet (final sheet), i.e., H2≥H1, and such that a widthwise length L2 thereof is longer than a length L1 of the staple 133, i.e., L2≥L1.

When the sheet bundle BS is discharged to the discharge tray 137, the microcomputer 701 judges whether or not the discharged sheet bundle BS is a final bundle in Step S725. If it is not the final bundle, i.e., NO in Step S725, the microcomputer 701 repeats the abovementioned operations of forming and discharging a new sheet bundle BS to the discharge tray 137 until when a final bundle is formed. The microcomputer 701 finishes the print job in a stage when the final bundle is discharged to the discharge tray 137 in Step S726.

Figure 18A:
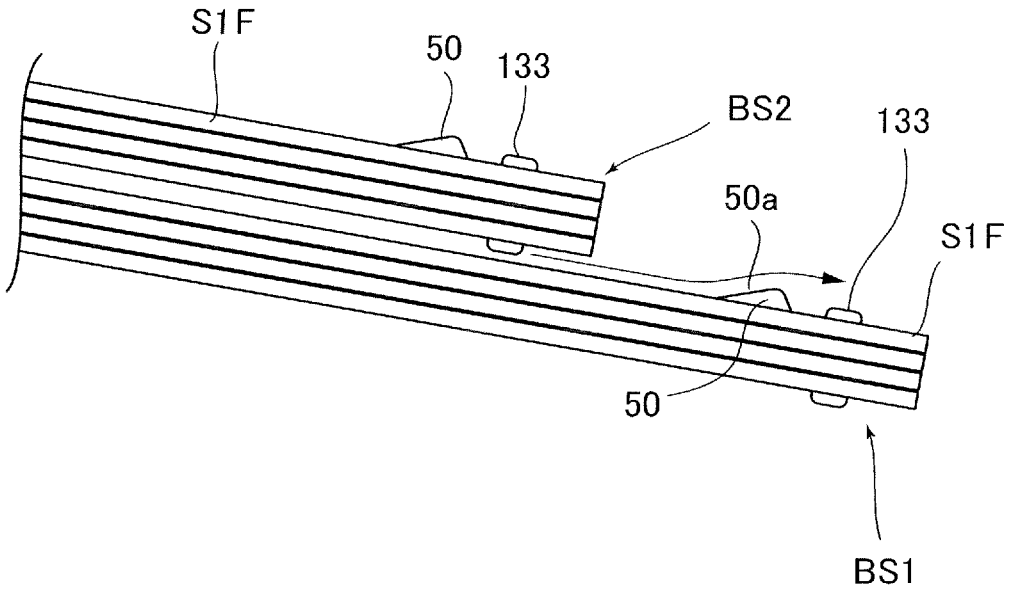
FIG. 18A illustrates a condition in which a succeeding sheet bundle is discharged to the discharge tray in an operation of the succeeding sheet bundle on the discharge tray.

The sheet bundle BS discharged to the discharge tray 137 moves on a sheet bundle already discharged to and stacked on the discharge tray 137, other than the sheet bundle discharged first, and abuts against the aligning wall 140. At this time, because the projection 50 is being formed on the top surface sheet S1F of the already stacked sheet bundle BS1 already stacked, the succeeding sheet bundle BS2 is guided toward the aligning wall 140 by the slope 50*a* of the projection 50 as shown in FIG. 18A.

Figure 18B:
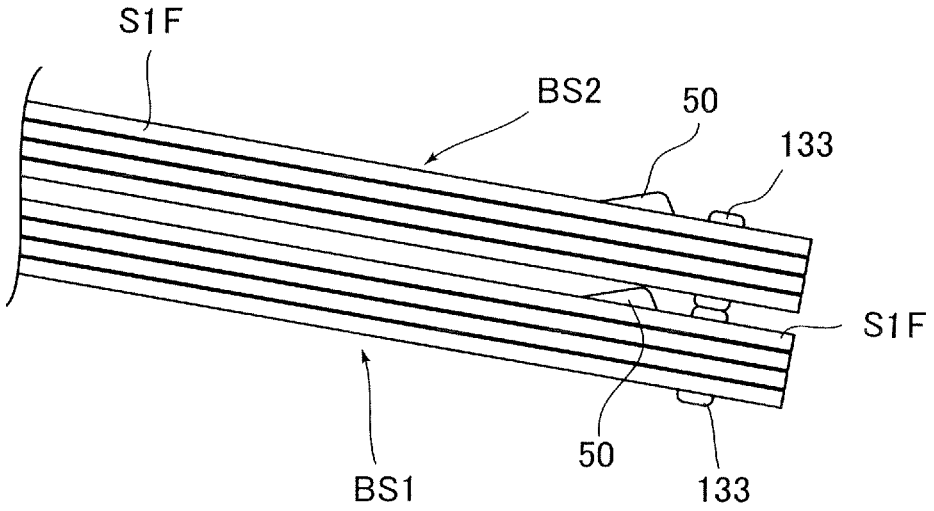
FIG. 18B illustrates a condition in which the succeeding sheet bundle is aligned with a preceding sheet bundle in the operation of the succeeding sheet bundle on the discharge tray.

At this time, the projection 50 projects to a height that enables to guide the succeeding sheet bundle BS2 toward the aligning wall 140 above the staple 133 on the top surface of the sheet bundle restricted by the aligning wall 140. Therefore, the succeeding sheet bundle BS2 rides over the projection 50 without its staple 133 being caught by the staple 133 of the already stacked sheet bundle BS1, and is aligned on the discharge tray 137 as shown in FIG. 18B.

Still further, because the projection 50 is provided at the position where the projection 50 prevents interference between the staple 133 of the already stacked sheet bundle BS1 and the succeeding sheet bundle BS2, it is possible to prevent the sheet end of the succeeding sheet BS2 from interfering with the staple 133 of the already stacked sheet bundle BS1 and from turning up. Thus, the projection 50 is a guide projection that guides the end in the moving direction of the succeeding sheet bundle BS2 discharged to the discharge tray (second stacking portion) 137 so that the succeeding sheet bundle BS2 moves above the binding portion 133 of the already stacked sheet bundle BS1 toward the aligning wall (restricting member) 140. Thus, the projection 50 makes it possible to align the succeeding sheet bundle BS2 neatly on the discharge tray 137 by preventing the succeeding sheet bundle BS2 from being caught by the staple 133 of the already stacked sheet bundle BS1 during its discharge. This arrangement makes it also possible to equalize the sheet bundles as products discharged on the discharge tray 137.

Still further, because the projection 50 projects above the top surface sheet more than the height of the staple 133, i.e., the binding member of the sheet bundle BS and the widthwise length thereof is longer than that of the staple 133, it is possible to prevent the interference otherwise caused between the succeeding sheet bundle BS2 and the staple 133 effectively.

Because the projection 50 also has the slope 50*a* whose height gradually increases in the direction in which the sheet bundle moves on the discharge tray toward the aligning wall 140, the sheet bundle BS can smoothly ride over the projection 50.

Figure 19A:
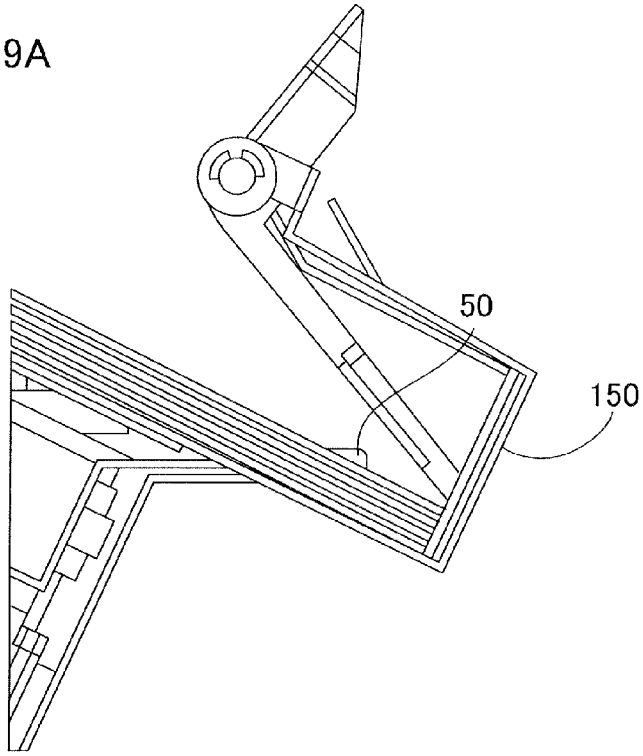
FIG. 19A illustrates a sheet bundle in which a projection is formed only on an upper sheet.
Figure 19B:
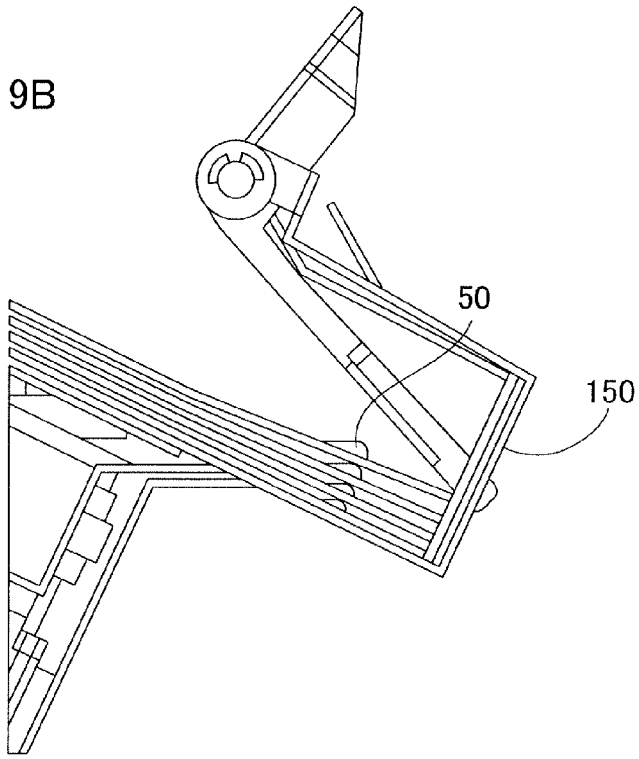
FIG. 19B illustrates a case when projections are formed on all sheets of the sheet bundle.

Still further, although the projection forming unit 201 may form the projection 50 on each of all sheets S as shown in FIG. 19B, the projection 50 is formed only on the top surface sheet S1F as shown in FIG. 19A in the present embodiment. Due to that, it is possible to thin a rear end of the sheet bundle BS on the processing tray 138. Accordingly, it is possible to minimize an influence given to the alignment operations of the projections 50 in the sheet conveying direction at the rear end stopper 150 and in the sheet width direction carried out by the front and back width aligning plates 340 and 341. This arrangement also makes it possible to shorten a time for forming the projection 50 within a processing time required for preparing the sheet bundle BS, thus contributing to speeding up of the preparation of the sheet bundle. This arrangement also makes it possible to reduce noise of operation in forming the projections in preparing the sheet bundle.

The image forming apparatus (finisher) of the present embodiment can form the projection 50 such that the succeeding sheet bundle is stacked without being caught by the binding portion of the sheet bundle stacked previously even when the sheet bundle is stapled at a corner thereof such that a staple is driven with a predetermined angle with respect to sides of an end portion of the sheet bundle.

Figure 20A:
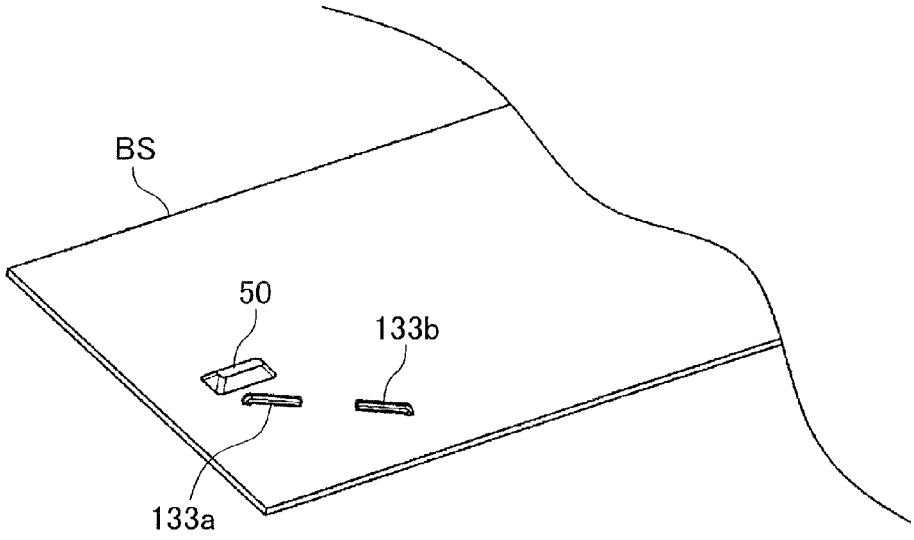
FIG. 20A illustrates a projection formed when a corner of a sheet bundle is stapled.
Figure 20B:
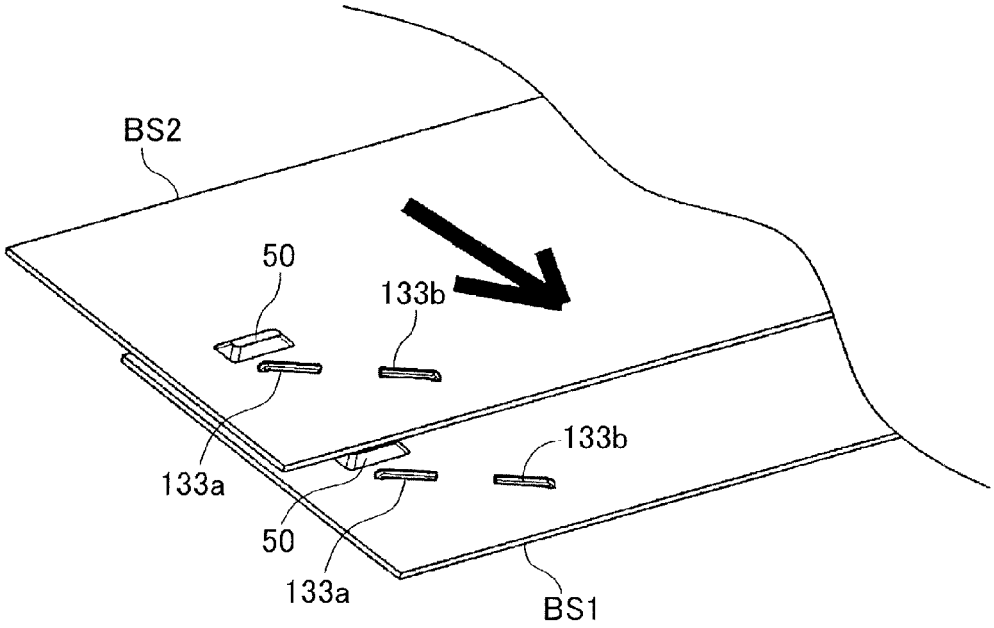
FIG. 20B illustrates a condition in which a succeeding sheet bundle is conveyed on the sheet bundle shown in FIG. 20A.

Specifically, when the sheet bundle is bundled by binding the corner thereof, a projection (convex shape) 50 is formed in the vicinity of the staple on a downstream end in the discharge direction of the staple 133*a* located most on the downstream side in the discharge direction so as to extend over the staple in the width direction in the stapled sheet bundle B as shown in FIG. 20A. That is, the projection 50 is disposed in the vicinity of the staple such that the projection 50 extends over the end of the staple 133*a* on the side that comes in contact first with the end of the succeeding sheet bundle BS2, i.e., the staple located on the upstream side most in the sheet bundle moving direction, in the already stacked sheet bundle BS1. This arrangement makes it possible to prevent the end of the discharged sheet bundle BS2 from being caught by the staple 133*a* of the already stacked sheet bundle BS1 that comes into contact first with the succeeding sheet bundle BS2 as shown in FIG. 20B, even if the projection forming position and the staple position of the stapler 132 deviate from each other due to installation allowance or the like.

Second Embodiment

A second embodiment of the invention will now be described. It is noted that the second embodiment is different from the first embodiment in that the second embodiment is arranged to be able to form a projection in a direction in parallel with the sheet bundle moving direction. The same or corresponding configuration of the present embodiment with those of the first embodiment will be denoted by the same or corresponding reference numerals and, an explanation thereof will be omitted.

Figure 21A:
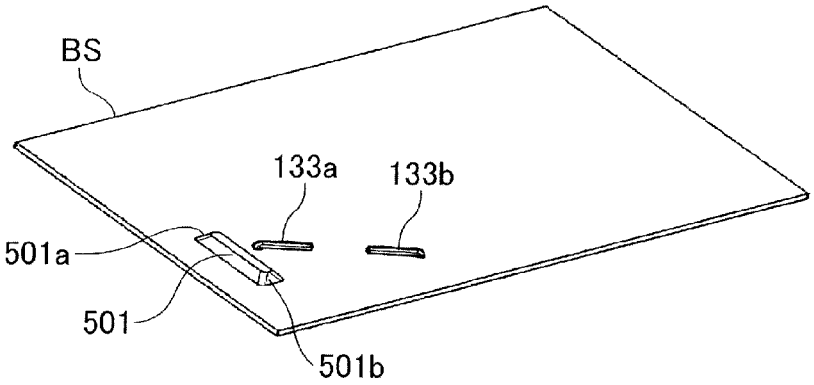
FIG. 21A illustrates a projection of a second embodiment.
Figure 21B:
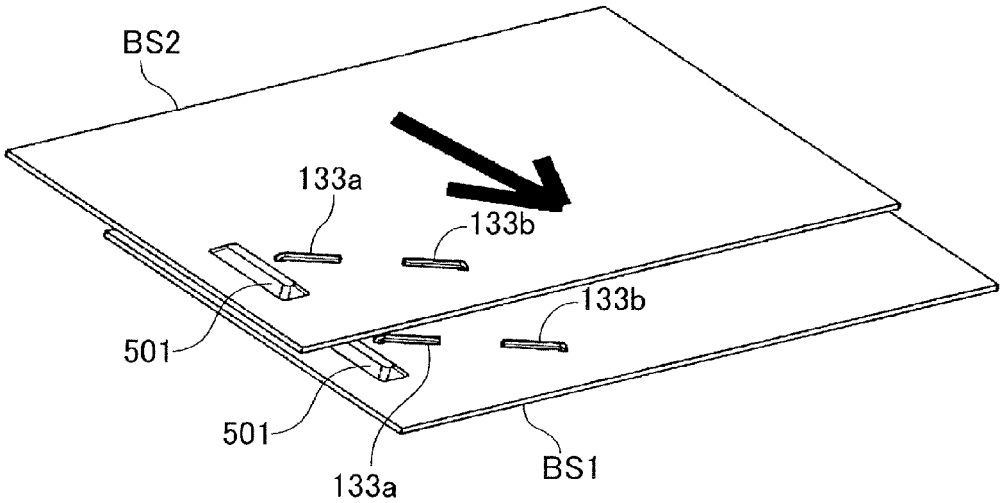
FIG. 21B illustrates a condition in which a succeeding sheet bundle is conveyed on the sheet bundle shown in FIG. 21A.

As shown in FIG. 21A, in order to form a projection (convex shape) 501 extending in a direction in parallel with the sheet bundle moving direction, a projection forming unit 201 of the second embodiment includes a projection forming portion 300*c* (see FIG. 6) having a punch 230*c* and a die 234*d* having different shapes from those of the projection forming portions 300*a* and 300*b* that form the projections 50 in the direction orthogonal to the sheet bundle moving direction. To that end, the projection forming unit 201 is configured to form the projection (convex shape) 501 in the direction in parallel with the sheet bundle moving direction so as to extend over a staple 133*a* in the direction in parallel with the sheet bundle moving direction in stapling the corner of the sheet as described above. When the projection 501 is formed at such position, it is possible to prevent an end of the discharged sheet bundle BS2 from being caught by the staple 133*a* of the already stacked sheet bundle BS1 as shown in FIG. 21B, even if the sheet of the sheet bundle is a thin sheet or is curled downward.

It is noted that the projection 501 also has a slope 501*a* that inclines upward toward the aligning wall 140 on the upstream side in the sheet bundle moving direction. A slope 501*b* on the downstream side in the sheet moving direction of the projection 501 declines toward the aligning wall 140.

Figure 22A:
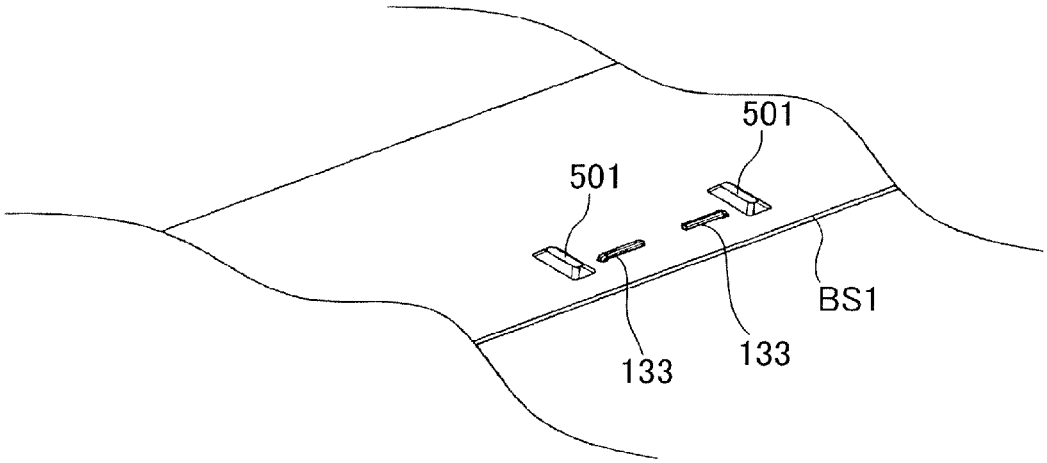
FIG. 22A illustrates a condition in which the projections of the second embodiment are applied to a sheet bundle in which staples are driven in parallel with an end of the sheet bundle.
Figure 22B:
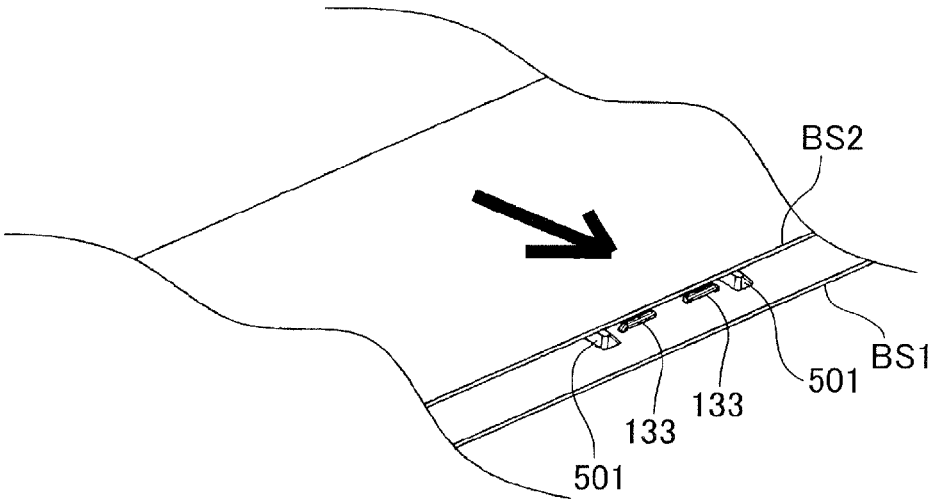
FIG. 22B illustrates a case when a succeeding sheet bundle is conveyed on the sheet bundle shown in FIG. 22A.

The projection forming unit 201 may form the projections 501 in the direction in parallel with the sheet moving direction on the sheet bundle BS1 stapled by the staples 133 in parallel with a side of the end of the sheet as shown in FIG. 22A. In this case, it is possible to prevent the end of the succeeding sheet bundle BS2 from being caught by the staple 133 as shown in FIG. 22B even if a sheet of the discharged sheet bundle BS2 is a thin sheet or is curled downward.

Third Embodiment

Next, a third embodiment of the invention will be described. It is noted that the third embodiment is different from the first and second embodiments in that a projection is formed at height regulating position where a difference of level in the width direction of the succeeding sheet bundle is reduced when the succeeding sheet bundle is discharged on a top surface sheet on the discharge tray. Accordingly, the same or corresponding configuration of the present embodiment with those of the first and second embodiments will be denoted by the same or corresponding reference numerals, and an explanation thereof will be omitted.

Figure 23:
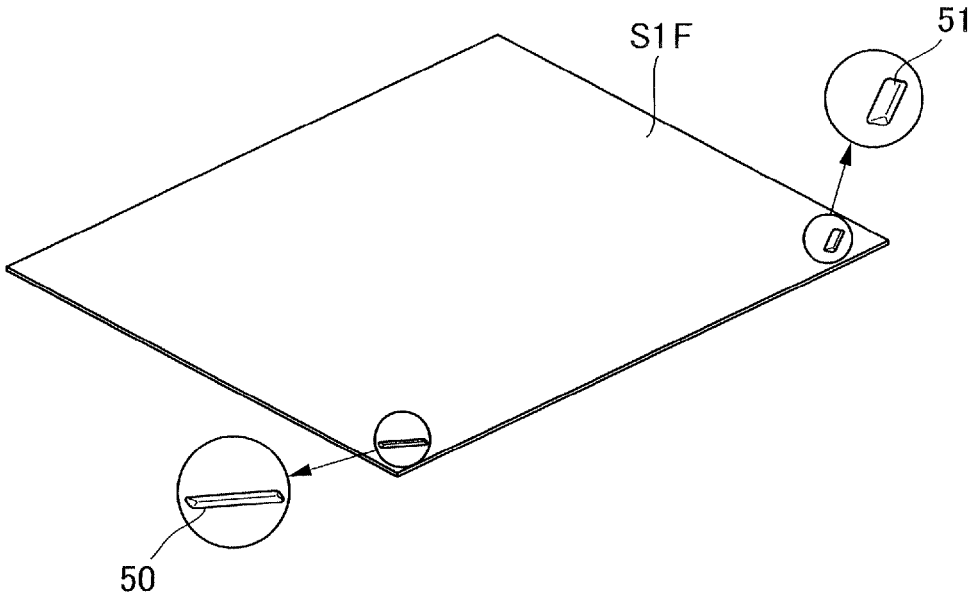
FIG. 23 is a perspective view illustrating height adjusted projections of a third embodiment of the invention.

As shown in FIG. 23, the projection forming unit 201 forms a height regulating projection 51 formed at height regulating position, in addition to the guide projection 50 (501) formed at the guide position, on the top surface sheet S1F. The height regulating projection 51 is formed at the height regulating position on a side opposite from the guide position where the guide projection 50 is formed in the width direction orthogonal to a direction in which the bundle is conveyed (discharge direction).

Figure 24A:
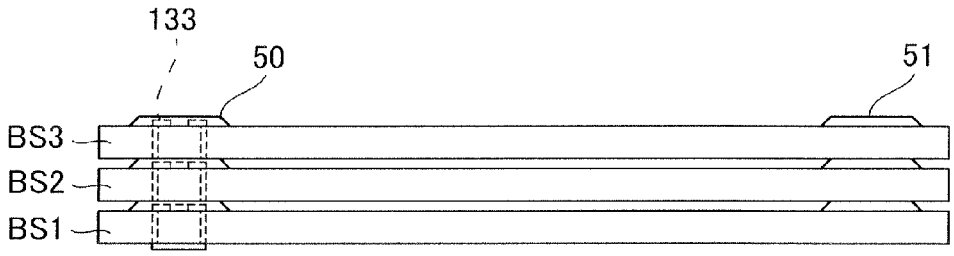
FIG. 24A illustrates sheet bundles discharged on a discharge tray in the third embodiment.
Figure 24B:
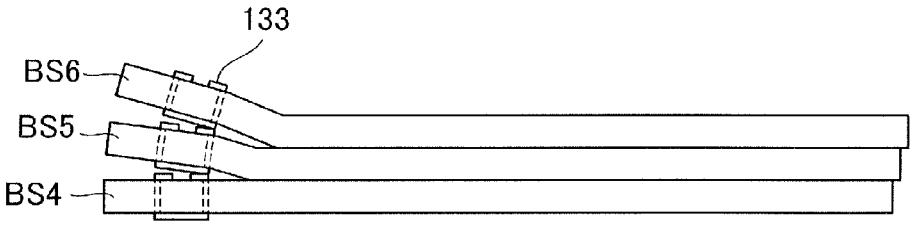
FIG. 24B illustrates a case when the height regulating projections are not formed.

FIG. 24B illustrates a condition in which sheet bundles BS4 through BS6 are discharged on the discharge tray when the projections 50 and 51 are not formed on the top surface sheets. Thus, only part around the staples 133 is heightened more than the other parts due to the projection of the staples 133 when the projections 50 and 51 are not formed. Therefore, due to a difference of frictional force in the width direction and to interference of the staples 133 with the heightened part, the sheet bundles BS4 through BS6 are stacked aslant on the discharge tray 137 and are unaligned.

Meanwhile, the height regulating projection 51 having the same shape with the guide projection 50 is formed on the side opposite widthwise from the guide projection 50, or more specifically, at a position symmetrical widthwise with the guide position as shown in FIG. 24A in the present embodiment. Due to that, there is no difference of levels in the width direction among the sheet bundles BS1 through BS3 discharged to the discharge tray 137. Thus, the height regulating projection 51 makes it possible to eliminate the difference of levels of the bundles based on the staples 133 and to eliminate disorder of the sheet bundles on the discharge tray based on the difference of levels of the bundles.

It is noted that although the height regulating projection 51 is provided together with the guide projection 50 in the present embodiment, the height regulating projection 51 may be provided solely. In this case, while it is preferable to equalize the height of the height regulating projection 51 to a height of the staple 133, position where the height regulating projection 51 is formed may be any position as long as it is a position where the widthwise difference of levels of the succeeding sheet bundle is reduced.

Fourth Embodiment

Next, a fourth embodiment of the invention will be described. It is noted that the fourth embodiment is different from the first through third embodiments in that a projection is formed on a sheet other than a top surface sheet. Accordingly, an explanation of the same or corresponding configuration of the present embodiment with those of the first through third embodiments will be omitted here.

As shown in FIG*s*. 25A through 25C, the projection forming unit 201 may implement the projection forming process on a plurality of sheets (a predetermined number of sheets including one sheet) including a top surface sheet of a sheet bundle so that the projections are not pressed down by weight of the discharged sheet bundle BS within a range in which the bulge of the projection does not affect the alignment operations when the projection is formed on a thin sheet for example.

Figure 25A:
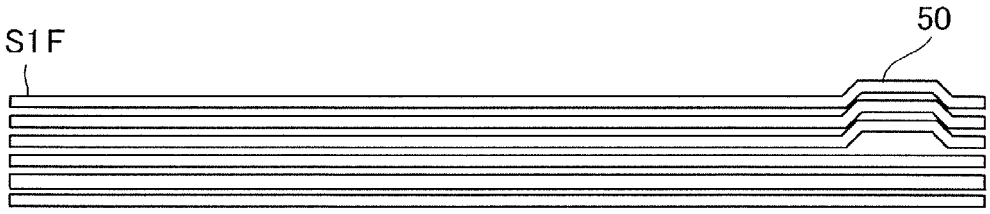
FIG. 25A illustrates a case when projections are formed on a plurality of sheets.
Figure 25B:
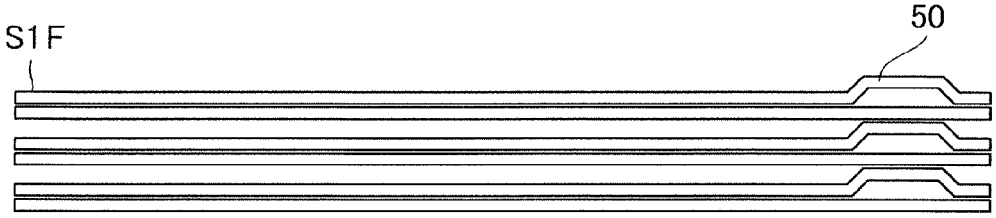
FIG. 25B illustrates a case when sheets on which projections are formed and sheets on which no projection is formed are alternately layered.
Figure 25C:
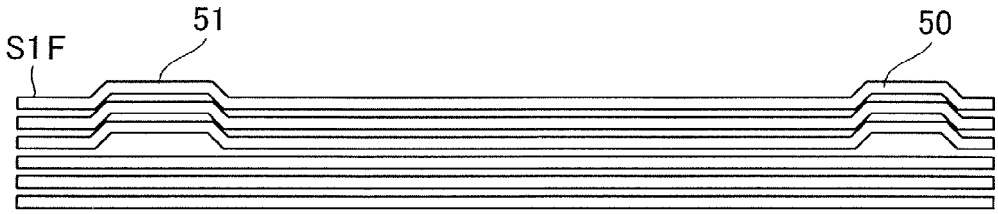
FIG. 25C illustrates a case when guide projections and the height regulating projections are formed on a plurality of sheets.

Specifically, guide projections 50 may be formed on three sheets for example from a top surface sheet S1*f* as shown in FIG. 25A. Still further, a sheet on which the projection 50 is formed and a sheet on which no projection is formed may be layered alternately with each other as shown in FIG. 25B. Both of the guide projections 50 and the height regulating projections 51 may be also formed on the plurality of sheets as shown in FIG. 25C. That is, the projection forming unit 201 forms the projections 50 and 51 at least on the top surface sheet S1F.

It is noted that although the stapler of the type that bundles sheets by using the staple 133 as the binding portion has been used in the embodiments described above, it is not always necessary to use the staple, and a stapler that binds sheets by folding the sheets without using a staple may be also used. As such stapler, there have been known a type that binds a sheet bundle by forming a binding clipping claw portion, and a type that forms convex and concave teeth engageably and binds the sheet bundle by engaging the convex and concave teeth. Therefore, the member for stapling the sheets is not always necessary to be the staple, and may be the sheets to be folded as described above or may be any stapling member, e.g., a pin, other than the staple.

Figure 26:
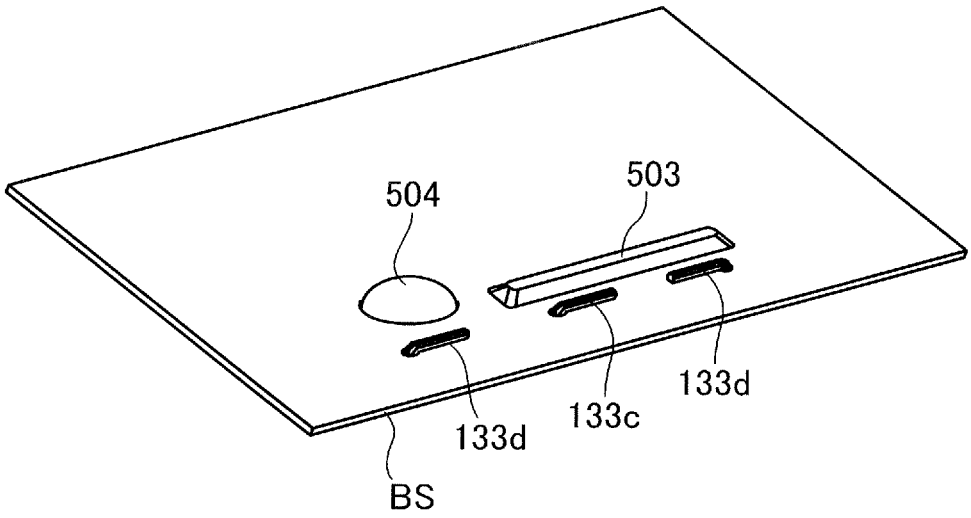
FIG. 26 illustrates a projection of another embodiment.

The disposition and shapes of the punch and the cam and the structure of the cam groove of the projection forming unit may be modified in any way so that a plurality of patterns of projections can be formed. For instance, while the projections whose longitudinal direction is orthogonal, parallel and oblique to the sheet bundle moving direction have been described in the embodiments described above, the invention is not limited to those cases. For instance, the punch 230*d* and the die 234*d* of the projection forming unit may be modified to be able to form a projection 503 as shown in FIG. 26 that extends over both sides of a plurality of adjacent staples 133*c* and 133*d*. This projection 503 makes it possible to prevent an end of a discharged sheet bundle from being caught by the staple 133 of the already stacked sheet bundle that comes into contact with the end of the sheet bundle even if the projection forming position of the projection forming unit deviates from the staple position of the stapler due to an installation allowance or the like.

Still further, the shape of the projection formed on a sheet by the punch 230*d* and the die 234*d* may be semi-globular as indicated by a projection 504 in FIG. 26. The projection forming unit can form a plurality of types of projections by the same punch and die by installing a rotating portion that rotates the punch and die. In addition, the projection forming unit may be configured as a unit that forms the projection by discharging a material such as resin hardened by heat, light, or the like.

Still further, although the rear edge of the sheet bundle has been stapled by the stapler 132 after forming the projection 50 on the sheet in the embodiments described above, the projection forming process may be carried out on a sheet bundle after stapling the sheet bundle. The projections 50 may be formed also on all of sheets composing a sheet bundle. The finisher 100 may be also built in the copier body 602 integrally as a sheet discharge apparatus, and the embodiments described above may be combined in any manner.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-155355, filed on Jul. 11, 2012, 2012-202798, filed on Sep. 14, 2012, 2012-202799, filed on Sep. 14, 2012, and 2013-134035, filed on Jun. 26, 2013 which are hereby incorporated by reference herein in its entirety.

What is claimed is:

1. A sheet processing apparatus, comprising:

a first stacking portion on which sheets to be processed are sequentially stacked;

a binding unit configured to implement a binding process to a sheet bundle composed of a plurality of sheets stacked on the first stacking portion;

a sheet bundle moving portion configured to discharge the sheet bundle to which a binding process has been implemented by the binding unit out of the first stacking portion;

a second stacking portion configured to stack the sheet bundle discharged out of the first stacking portion by the sheet bundle moving portion;

a restricting member configured to abut against an end portion in a moving direction of the sheet bundle discharged and moving on the second stacking portion to align a position in the moving direction of the sheet bundle; and a projection forming unit configured to form a guide projection on a top surface of the sheet bundle such that the guide projection guides an end portion in the moving direction of a succeeding sheet bundle moving toward the restricting member above a binding portion of the sheet bundle on the second stacking portion.

2. The sheet processing apparatus according to claim 1, wherein the projection forming unit forms at least a part of the guide projection at a position on a side opposite from the restricting member with respect to the binding portion of the sheet bundle in the moving direction of the sheet bundle.

3. The sheet processing apparatus according to claim 2, wherein the projection forming unit forms the guide projection at a position where the binding portion of the sheet bundle stacked on the second stacking portion and at least a part of the guide projection overlap in a width direction orthogonal to the moving direction of the sheet bundle.

4. The sheet processing apparatus according to claim 3, wherein the projection forming unit forms the guide projection such that the guide projection extends over the binding portion of the sheet bundle that comes into contact first with an end in the moving direction of a succeeding sheet bundle in the width direction orthogonal to the moving direction.

5. The sheet processing apparatus according to claim 1, wherein the guide projection is formed to be higher than a height of the binding portion of the sheet bundle on the second stacking portion, the binding portion projecting above a top surface of the sheet bundle.

6. The sheet processing apparatus according to claim 1, wherein the projection forming unit forms the guide projection in the vicinity of the binding portion of the sheet bundle such that the projection extends over the binding portion of the sheet bundle in the moving direction of the sheet bundle.

7. The sheet processing apparatus according to claim 1, wherein the guide projection has a slope inclined such that its height gradually increases toward the restricting member.

8. The sheet processing apparatus according to claim 1, wherein the guide projection is formed into a semi-globular shape.

9. The sheet processing apparatus according to claim 1, wherein the projection forming unit forms a height regulating projection that reduces a difference of levels of the succeeding sheet bundle in a width direction orthogonal to the moving direction when the succeeding sheet bundle is discharged on a top surface of the preceding sheet bundle.

10. The sheet processing apparatus according to claim 9, wherein the projection forming unit forms the height regulating projection at position symmetrical to the guide projection in the width direction.

11. The sheet processing apparatus according to claim 1, wherein the projection forming unit forms guide projections on a predetermined number of sheets including at least the top surface sheet in the sheet bundle.

12. The sheet processing apparatus according to claim 1, wherein the projection forming unit is provided upstream in a sheet conveying direction of the first stacking portion and forms the guide projection on a sheet before the sheet is conveyed to the first stacking portion.

13. The sheet processing apparatus according to claim 1, wherein the binding process of the binding unit is implemented by binding the sheet bundle by a staple.

14. A sheet processing apparatus, comprising:

a first stacking portion on which sheets to be processed are sequentially stacked;

a stapler that staples a sheet bundle composed of a plurality of sheets stacked on the first stacking portion;

a second stacking portion, having an inclined stacking surface, to which the sheet bundle stapled by the stapler is discharged;

an aligning wall against which an end in a moving direction of a sheet bundle moving along an inclination of the stacking surface abuts;

a projection forming unit including a punch and a die capable of forming a projection projecting to one side from a surface of a sheet; and a control portion that drives the projection forming unit to form the projection by the punch and die at least on a sheet located at a top surface of the sheet bundle in discharging the sheet bundle to the second stacking portion at position where at least a part of the projection is located on an upstream side in the moving direction of a position stapled by the stapler.

15. The sheet processing apparatus according to claim 14, wherein the punch and die are formed such that the projection has a slope inclined upward toward the aligning wall in discharging the sheet bundle to the second stacking portion, and such that a height of the projection is higher than a height of a projection of a staple portion stapled by the stapler above the top surface of the sheet bundle.

16. The sheet processing apparatus according to claim 14, further comprising a shift unit provided upstream in the sheet conveying direction of a first stacking portion, the shift unit having a roller pair capable of conveying the sheet in the sheet conveying direction, and configured to be able to move the sheet in a width direction orthogonal to the sheet conveying direction;

wherein the projection forming unit includes a stopper member that protrudes on a sheet conveying path and defines a projection forming position in the sheet conveying direction by abutting against an end of the sheet; and wherein the control portion determines the projection forming position by conveying the sheet such that the end of the sheet abuts against the stopper member by controlling the roller pair of the shift unit and by moving the sheet in the width direction by the shift unit.

17. An image forming apparatus, comprising:

an image forming portion configured to form an image on a sheet; and a sheet processing apparatus of claim 1 configured to process the sheet on which the image has been formed by the image forming portion.

18. An image forming apparatus, comprising:

an image forming portion configured to form an image on a sheet; and a sheet processing apparatus of claim 14 configured to process the sheet on which the image has been formed by the image forming portion.

* * * * *